US009717651B2

(12) United States Patent
Hohl et al.

(10) Patent No.: US 9,717,651 B2
(45) Date of Patent: Aug. 1, 2017

(54) PILL CRUSHING CUP WITH ROTATIONAL LOCKING LUGS

(71) Applicant: First Wave Products Group, LLC, Batavia, NY (US)

(72) Inventors: Brian Hohl, Tonawanda, NY (US); Brian D. Bell, Wyoming, NY (US); Douglas Dufaux, Orchard Park, NY (US); David Rowlands, Honeoye Falls, NY (US)

(73) Assignee: First Wave Products Group LLC, Batavia, NY (US)

( * ) Notice: Subject to any disclaimer, the term of this patent is extended or adjusted under 35 U.S.C. 154(b) by 599 days.

(21) Appl. No.: 14/222,050

(22) Filed: Mar. 21, 2014

(65) Prior Publication Data

US 2014/0217221 A1 Aug. 7, 2014

Related U.S. Application Data

(63) Continuation-in-part of application No. PCT/US2013/052298, filed on Jul. 26, 2013.
(Continued)

(51) Int. Cl.
*A61J 7/00* (2006.01)

(52) U.S. Cl.
CPC ..... *A61J 7/0007* (2013.01)

(58) Field of Classification Search
CPC ..... A61J 7/0007
(Continued)

(56) References Cited

U.S. PATENT DOCUMENTS 4,575,014 A 3/1986 Szalanski
4,756,484 A 7/1988 Bechler
(Continued)

FOREIGN PATENT DOCUMENTS

| | | |
|---|---|---|
| JP | 2001-219084 | 8/2001 |
| KR | 10-0908611 | 7/2009 |
| WO | 2011/103616 | 9/2011 |

OTHER PUBLICATIONS

Min, in Gyou, "International Search Report", mailed Jun. 30, 2015 for application No. PCT/US2015/021745, Korean Intellectual Property Office, Daejeon, Republic of Korea.
(Continued)

*Primary Examiner* — Mark Rosenbaum
(74) *Attorney, Agent, or Firm* — Woods Oviatt Gilman LLP; Katherine H. McGuire, Esq.

(57) ABSTRACT

A pill crushing apparatus for use with first and second nestable cups comprising a first cup holder which is moved linearly toward a second cup mounting surface holding a second cup. The first cup holder rotates relative to the rotationally fixed second cup. During the crushing process, the pills first may begin to crush against the linear load being applied thereto, and thereafter grind into a fine powder due to the rotational force of the first cup against the second cup. The first cup and second cup have different sidewall angles to promote pill crushing while inhibiting migration of the crush material to prevent the crushed material from reaching the open gap between the top perimeters of the nesting cups. Each cup includes a plurality of lugs having a curved profile configured to engage respective recesses on the cup holders. Each cup is fabricated through thermoforming or vacuum forming techniques.

16 Claims, 25 Drawing Sheets

Related U.S. Application Data

(60) Provisional application No. 61/676,281, filed on Jul. 26, 2012.

(58) Field of Classification Search
USPC ..... 241/DIG. 27
See application file for complete search history.

(56) References Cited

U.S. PATENT DOCUMENTS

| | | | | |
|---|---|---|---|---|
| 5,118,021 | A | 6/1992 | Fiocchi | |
| 5,618,004 | A * | 4/1997 | Klearman | A61J 7/0007 241/169.2 |
| 7,543,770 | B2 * | 6/2009 | Peron | A61J 7/0007 241/169 |
| 2006/0043225 | A1 | 3/2006 | Peron | |
| 2006/0088422 | A1 | 4/2006 | Hall et al. | |
| 2007/0181724 | A1 | 8/2007 | Shears | |
| 2009/0072059 | A1 | 3/2009 | Bell | |
| 2012/0160946 | A1 | 6/2012 | Anderson | |

OTHER PUBLICATIONS

Chang, Bong Ho, "Written Opinion of the International Searching Authority", mailed Oct. 30, 2013 for application No. PCT/US2013/052298, Korean Intellectual Property Office, Daejeon, Republic of Korea.

* cited by examiner

PILL CRUSHING CUP WITH ROTATIONAL LOCKING LUGS

This application is a continuation-in-part of pending PCT application Ser. No. PCT/US2013/052298, filed Jul. 26, 2013, entitled PILL CRUSHING SYSTEM, which claims the benefit of U.S. Provisional Application No. 61/676,281, filed Jul. 26, 2012, both of which are incorporated herein by reference.

BACKGROUND OF THE INVENTION

The present invention relates to pill crushing systems, and more particularly relates to a pill chip guard which acts to inhibit pill chips from escaping the pill crushing chamber during the pill crushing operation. In another aspect, the invention relates to nestable cups having improved pill crushing features and interfacing dimensions which inhibit migration of the powdered pill material from reaching the top perimeters of the cups. In yet another aspect, the invention relates to nestable cups where the bottom cup and top cup each have a plurality of spaced locking lugs configured to engage complementary spaced recesses within a respective cup holder so as to ensure that the one or the other bottom or top cup and its respective cup holder rotate together upon activation of the pull crushing system.

The grinding or crushing of pills into powder form may be necessary when, for example, the person has trouble swallowing whole pills due to throat problems. This is a common need in nursing homes and hospitals. While the very first pill crushing device was most likely the mortar and pestle (which is still used today), more technologically advanced pill crushing devices have been developed over the years (manually or electrically driven) which have various designs that offer advantages over the mortar and pestle, such as making the pill crushing operation quicker, easier and safer (e.g., by preventing cross-contamination between different Rx pills ground in succession), for example.

Some pill crushing devices utilize a pair of disposable cups which may be nested together with the pill located therebetween. As one cup is rotated relative to the other cup, the pill is ground into a powder. The top cup is removed, leaving the powered pill inside the bottom cup. An additive such as juice or applesauce, for example, may be added to the cup and mixed with the powder to form a liquid or slurry which the patient may more easily swallow. An example of such a nested cup pill crushing device may be seen in commonly owned U.S. Patent Publication No. US 2012/0160946, the entirety of which is incorporated herein by reference. While the device of the '946 publication provides advances over the prior art, there remains a possibility that some pill chips may unintentionally escape from between the cups during the crushing operation. It would furthermore be desirable to improve the crushing of the pills into a finer powder to ensure uniform mixing with the liquid additive and ease of swallowing. It would be yet furthermore desirable to provide nesting cups having differing geometries which interface in a manner inhibiting the migration of the fine powder from reaching the top perimeters and spilling out from between the nesting cups. While the devices disclosed within these references provide, to various degrees of suitability, the ability to crush pills into a fine powder, there remains the possibility that the bottom cup or top cup may unintentionally disengage with its respective cup holder thereby minimizing or elimination the requisite rotational grinding interaction between the nested cups. As such, it would be desirable to provide nesting cups having improved cup/cup holder interfaces to minimize or eliminate cup migration during rotational grinding of the loaded pills. Furthermore, it would be desirable to fabricate improved nestable cups through a thermoforming or vacuum forming operation.

SUMMARY OF THE INVENTION

In one aspect, the present invention addresses the above concern of pill chips escaping from between the cups by providing a chip guard positioned to physically block pill chips from exiting between the nested cups during the pill crushing operation. In another aspect, the present invention provides improved nested cup designs which enhance distribution of the pill material between the facing surfaces of the cups during the crushing operation, yet also inhibit the migration of the fine powder from reaching the top open perimeters of the nesting cups. Forcing the pill material as it is being crushed to spread out between a larger surface area increases the amount of pill material subjected to the frictional grinding forces of the nested cups and thereby forms a finer powder than achieved by prior art nested cup designs. Furthermore, including interfacing cup geometries which inhibit migration of the fine powder to the open cup perimeters prevents the loss of pill material from between the open edges of the cups.

In an embodiment, the present invention provides a pill crushing machine having a bottom cup holder positioned in a main housing and a top cup holder positioned on the inside of a lid hinged to the main housing. A pair of nestable cups are provided for removable placement in the pill crushing machine. The bottom cup is placed upon the bottom cup holder with the pills to be crushed placed inside the bottom cup. The top cup is nested inside the bottom cup with the pills located between the nested bottom and top cups and the lid is moved to the closed position. The machine is activated causing the bottom cup to rise up against and then rotate relative to the stationary top cup. The resultant forces and friction between the bottom and top cups cause the pills located therebetween to be crushed and ground into a powder. The lid is then opened whereupon the top cup is separated from the bottom cup wherein the pill powder is located. A liquid food additive such as juice, applesauce, pudding or the like may be mixed with the powder to form a slurry and given to the patient in a now more easily swallowed form. While described as having a rotating bottom cup and stationary top cup, it is envision that a machine can operate in an inverse relation wherein the top cup rotates and the bottom cup is stationary.

In the preferred embodiment, the pill crushing machine biases the nested cups toward one another. As the pills undergo the crushing operation, they begin to crack and pulverize into smaller and smaller particles that migrate radially outwardly along the facing surfaces of the cups and, depending on the amount of pill material to be crushed, potentially also up the facing side walls of the cups toward the open top perimeters thereof. In the nested condition, a small gap may exist between the open top perimeters of the bottom and top cups. This creates an area wherethrough pill particles may escape from between the cups. This is undesirable in that any portion of the pills being crushed that do not remain in the cup are lost and the prescribed dose is thereby being unknowingly reduced which could potentially result in adverse health effects on the patient.

The present invention provides a pill crushing machine with a physical barrier at the location of the nested cups perimeter gap which acts as a "chip guard" to inhibit the escape of pill particles through this gap. In a preferred embodiment, the chip guard is in the form of a ring which is movable between an active guard position and a retracted cup access position allowing easy access to the nested cups into and out of the machine. In the active guard position, the ring wall encircles and lies in close proximity to the gap between the nested cups top perimeters, thereby forming a physical barrier to pill particles which may otherwise escape from between the cups at this gap.

In yet a further embodiment, the present invention provides a pair of nestable cups for a pill crushing machine wherein the bottom cup and top cup have different side wall angles to promote improved pill crushing and inhibit migration of the powdered pill material from reaching the open gap between the cup top perimeters. The respective cup dimensions are selected so as to cause more pronounced migration of the pill particles in a radially outward direction along the facing cup walls. Radial and even migration of the pill particles between the cups is desirable in that the more cup surface area that is actively grinding against the pill particles, the more pill particles will be subject to continuous grinding which results in a finer (smaller) resultant particle size. The finer the resultant powder, the better the powder will mix with the liquid food additive which will be easier to swallow for the patient than a mixture having larger pill particles therein. Furthermore, since the interfacing geometries of the nested cup side walls are such as to inhibit the fine powder from reaching the open top perimeters of the cups, the full amount of finely powdered pill material stays between the cups, and within the bottom cup.

In a further aspect, the present invention addresses the above concern of either or both the bottom cup or top cup disengaging from its respective cup holder by providing a bottom cup and top cup each having spaced locking lugs which engage substantially the entire opening of complementary spaced recesses formed on their respective cup holders. In another aspect, the present invention provides an improved bottom cup and top cup wherein the cups are configured to carry spaced locking lugs having a rolled, curved or beaded transverse cross-section so as to provide sufficient structural support to the locking lugs so as to resist deformation, distortion or tearing of the locking lugs when seated within and engaged by the spaced recesses of the cup holders. Furthermore, it is object of the present invention to efficiently fabricate improved nestable cups inexpensively through thermoforming or vacuum forming techniques.

As described above, the pill crushing machine biases the nested cups toward one another wherein the bottom cup is rotated relative to the stationary top cup. To provide for proper rotational grinding each cup needs to be secured within its respective cup holder such that the cup does not move with respect to its designated cup holder. Rather, it is the rotational movement of one cup holder relative to the other that initiates the grinding process. Thus, to secure each cup within its cup holder, presently available pill cups have been designed to either include a plurality of protrusions that engage with recesses within the cup holder or to include a number of flange cutouts which align with and engage outwardly extending projections on the cup holder. However, presently available pill cups have cup protrusions that are generally small (as compared the entire circumferential area of the cup's perimeter flange) and are typically straight walled, single walled protrusions. As such, these protrusions are susceptible to deformation when rotationally engaged by the cup holder or through the torque generated by rotationally grinding a pill situated between the cups. Flange cutouts are similarly prone to deformation as the cup flange is generally comprised of a thin-walled plastic layer. Further, flange cutouts require an additional manufacturing step as the cup and flange need to be formed prior to punching the cutouts.

The present invention seeks to address these and other issues by providing a pill cup (either or both a bottom cup and a top cup) having locking lugs which engage substantially the entirety of respective recesses situated upon their respective cup holders. To provide even further structural support, in preferred embodiments the lugs are configured to include a curved transverse cross-sectional profile. The curved profiles may be either open or closed curves and may further include solid bead-like structures. In a further preferred embodiment, such cups may be fabricated through thermoforming/vacuum forming techniques from a thin sheet of suitable plastic.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION OF A PREFERRED EMBODIMENT

Figure 1:
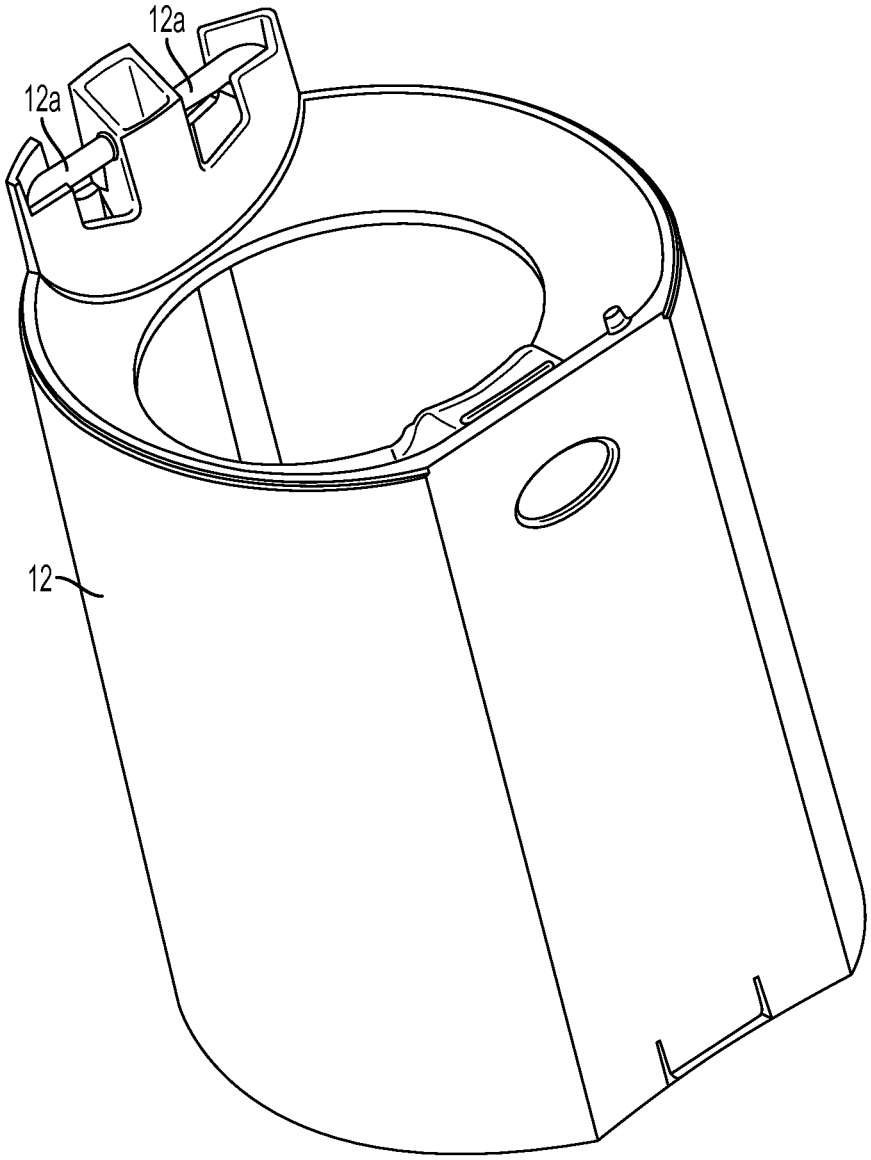
FIG. 1 is a perspective view of the main housing body.
Figure 2:
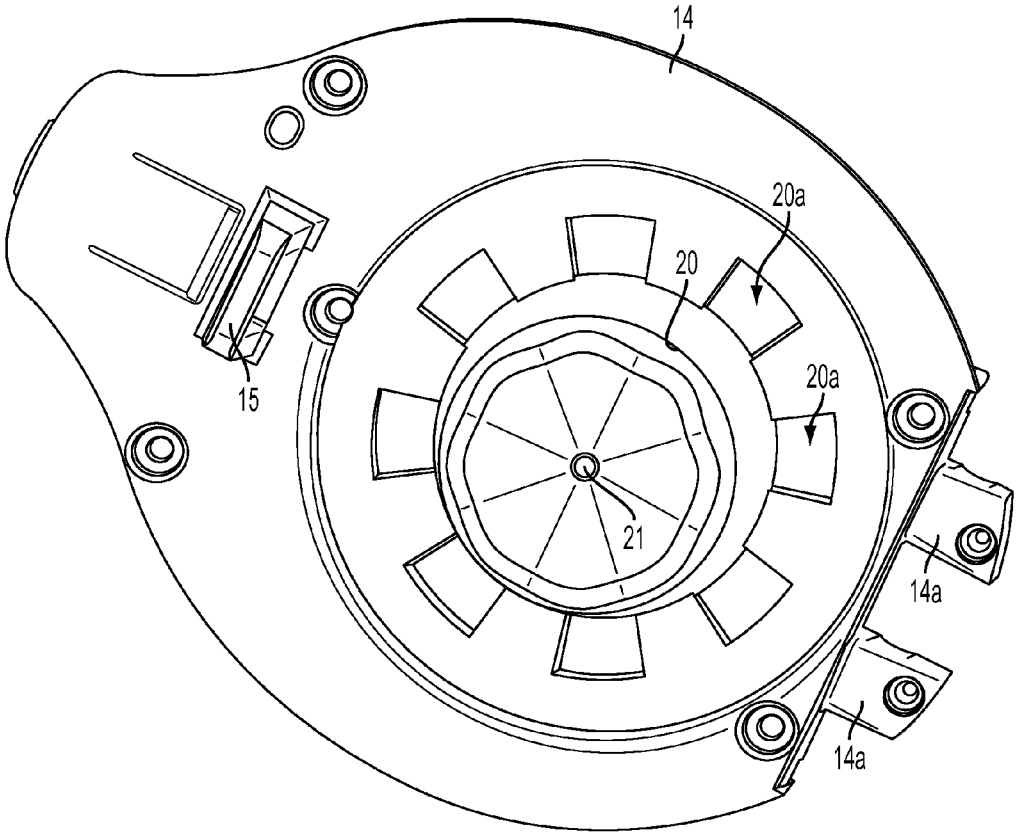
FIG. 2 is a perspective view of the underside of the lid.
Figure 3A:
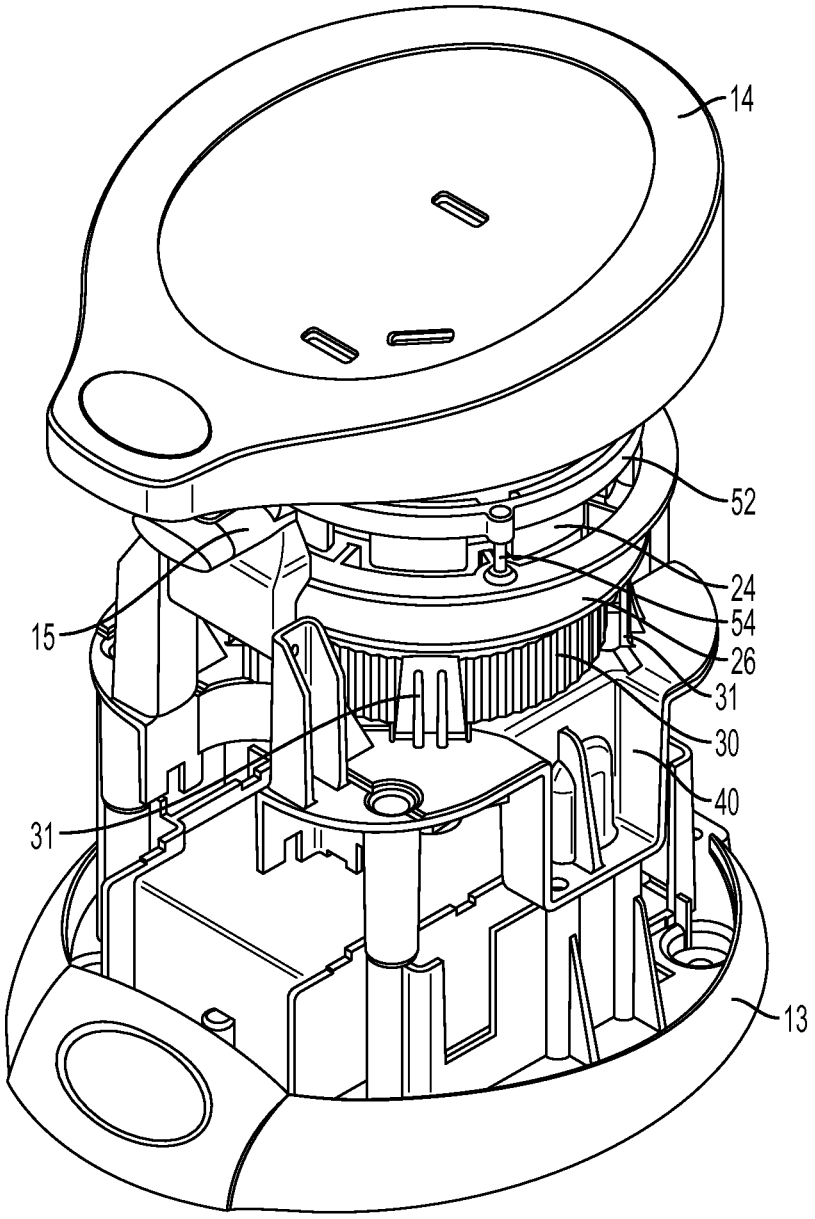
FIG. 3A is a perspective view to an embodiment of the pill crushing machine without the main body housing.
Figure 3B:
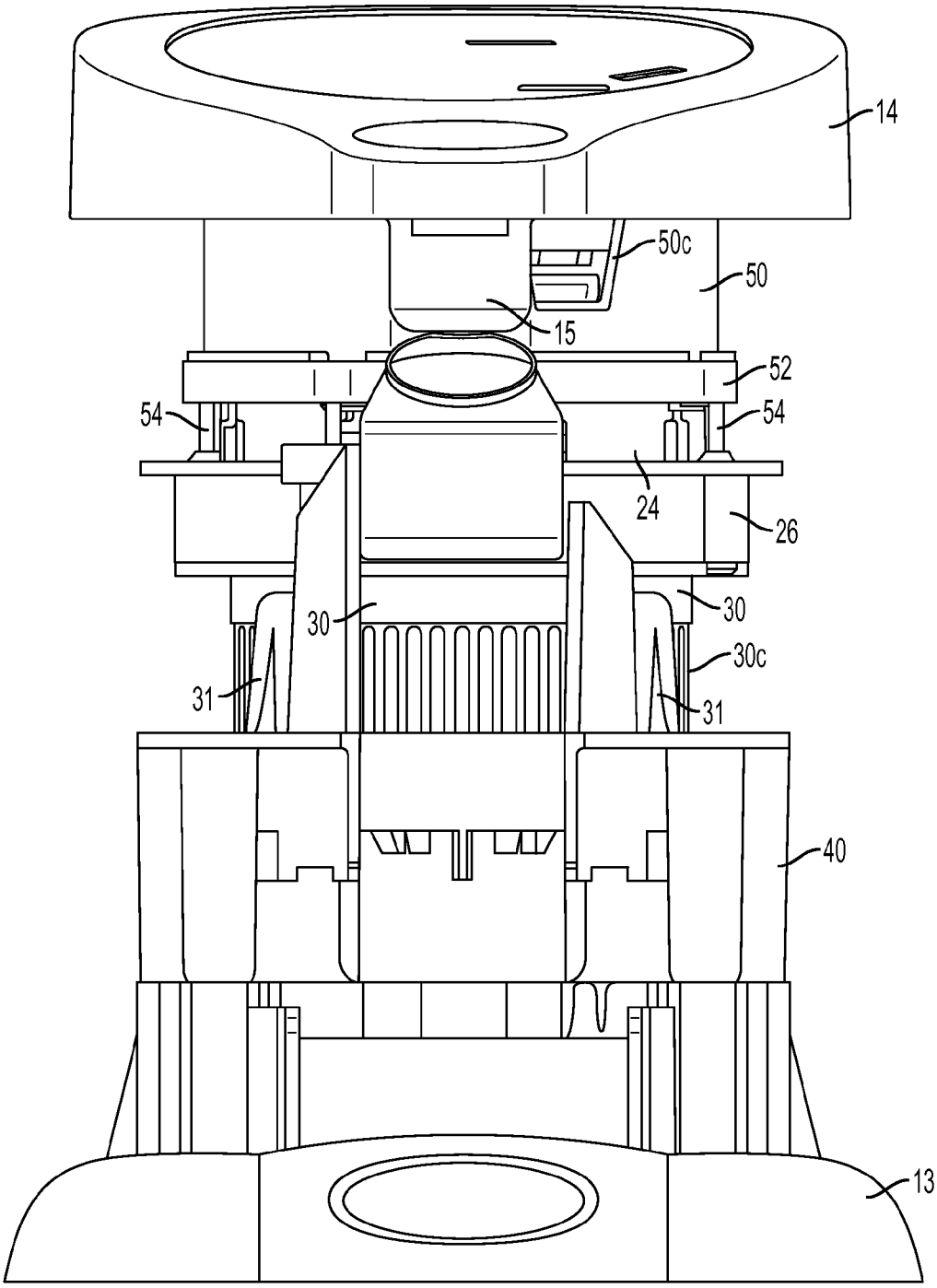
FIG. 3B is a front elevational view thereof.
Figure 3C:
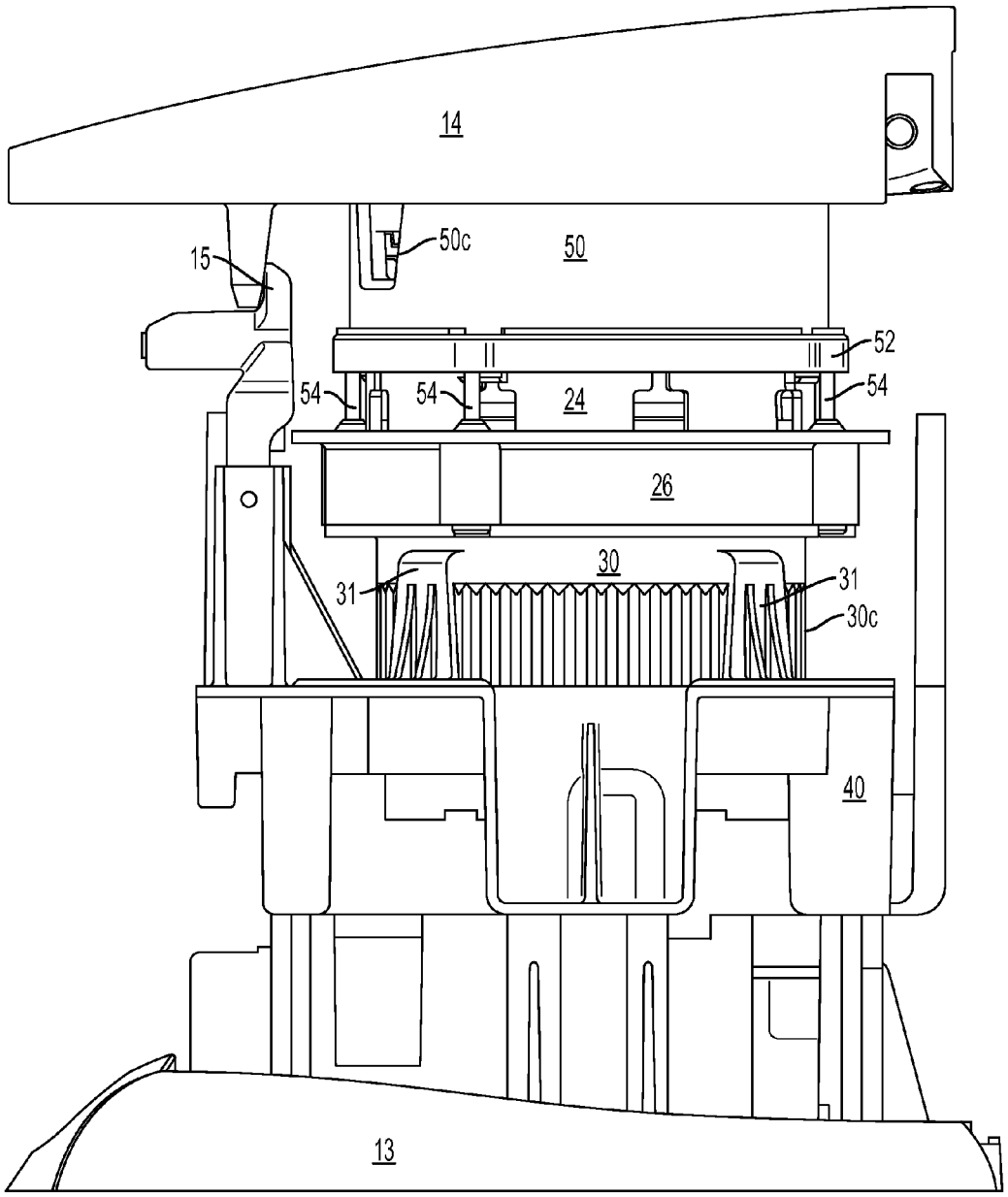
FIG. 3C is a side elevational view thereof.
Figure 3D:
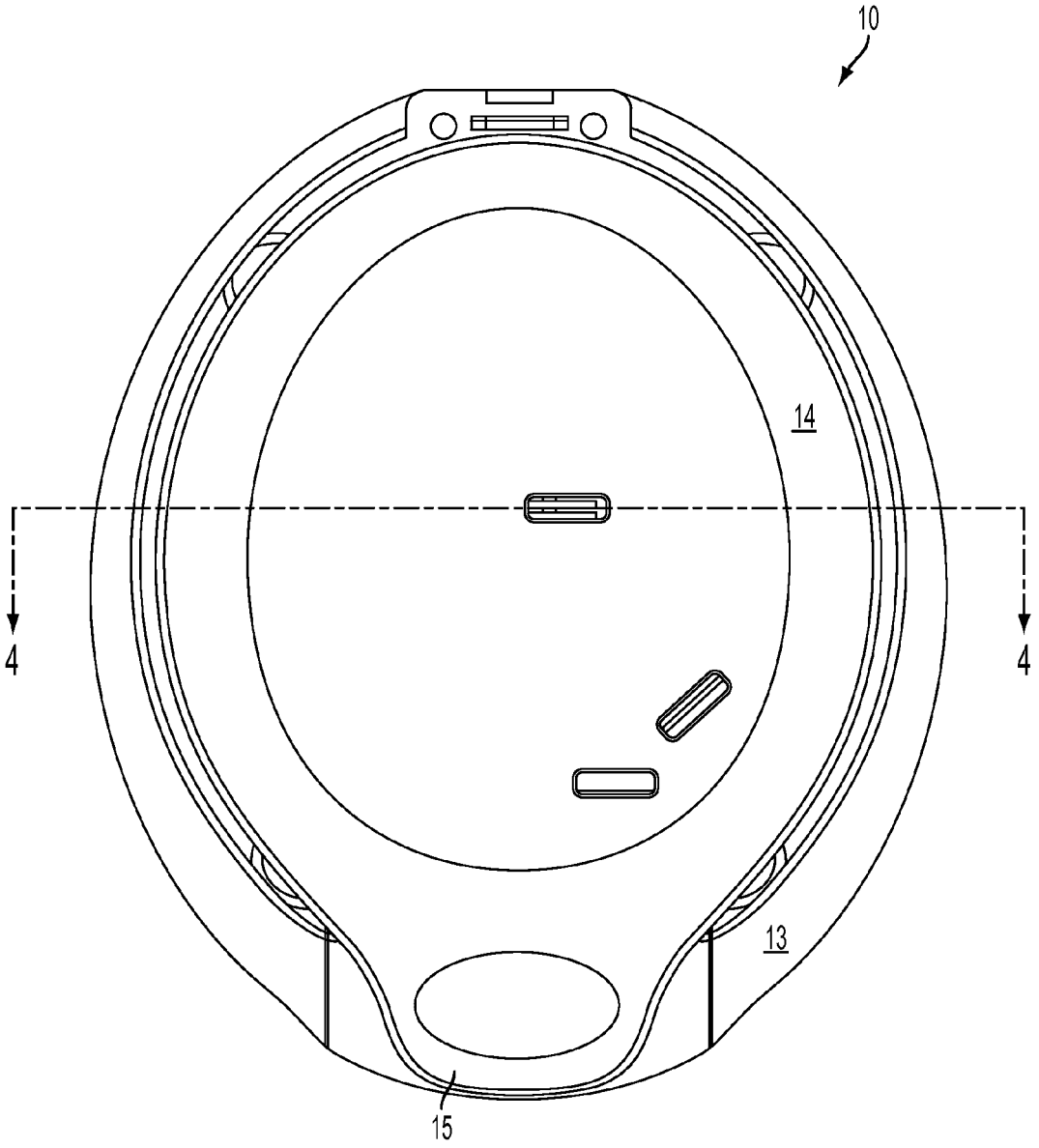
FIG. 3D is a top plan view thereof.

Referring now to the drawings, there is seen in the figures a pill crushing machine designated generally by the reference numeral 10 having a main housing body 12 and lid 14 which is hinge connected to housing body 12 via hinge elements 12*a* and 14*a* (see FIGS. 1 and 2). While the housing body 12 seen in FIG. 1 is not shown in the remaining figures for the sake of clarity, it is understood that it would extend between base 13 and lid 14 (see FIGS. 3A-5).

Figure 8A:
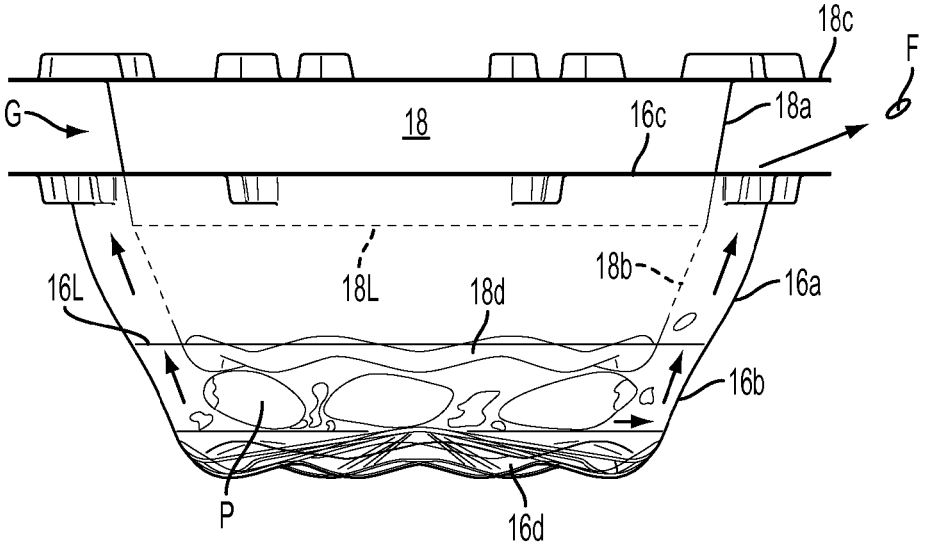
FIGS. 8A and 8B are side elevational views of the top and bottom cups in their nested condition at the beginning of the pill crushing operation and near the end of the pill crushing operation, respectively.

As seen in FIGS. 5, 6A-6D, 7A-7D, and 8A and 8B, a pair of nestable cups 16 and 18 are provided for use with machine 10 which are preferably single use and formed of a suitable plastic. In a preferred embodiment shown, bottom cup 16 and top cup 18 have different dimensions, with top cup 18 (which nests inside bottom cup 16 with pills "P" to be crushed deposited therebetween as seen in FIG. 8A) being overall generally smaller and having side walls 18*a* and 18*b* (which meet at line 18L) which are straight in the direction from lower wall segment 18*b* to upper perimeter flange 18*c* (seen best in the cross-section of FIGS. 6D and 8A and 8B). Upper wall segment 18*a* extends at an angle A1 of about 100° with respect to perimeter flange 18*c*, and lower wall segment 18*b* extending at an angle A2 of about 170° with respect to upper wall segment 18*a*. Rather than being straight, upper wall segment 16*a* of bottom cup 16 includes having an outwardly curved surface having a radius of about 1.380 mm and a lower wall segment 16*b* (which meets upper wall segment 18*a* at line 18L) having an inwardly curved surface having a radius of about 1.662 mm. The inwardly curved lower wall segment 16*b* interfaces closely with top cup lower segment wall 18*b* to promote fine grinding of the pill particles therebetween while the outwardly curved surface of bottom cup upper wall segment 16*a* interfaces with the sharper angled (i.e., more vertically inclined that the lower wall segment) straight upper wall segment 18*a* of top cup 18 so as to create a large enough space to inhibit pill powder migration as explained further below. The cup bottom walls 16*d* and 18*d* are of a non-planar configuration and include a radial pattern of fluted sections 16*d*' and 18*d*', respectively. Top cup perimeter flange 18*c* includes a plurality of annularly spaced, upwardly-facing (in a direction away from bottom wall 18*d*) protrusions 18*e*, and bottom cup perimeter flange 16*c* includes a plurality of annularly spaced, downwardly-facing (in a direction toward bottom wall 16*d*) protrusions 16*e*, the purpose of which is described below.

Lid 14 includes a top cup holder 20 having a geometry complimentary to the geometry of the respective inside surfaces of the top cup 18 to be removably placed thereon which thus forms a mating fit between the two when the top cup 18 is removably mounted onto the top cup holder 20. In a further preferred embodiment, a spring loaded plunger 21 may be provided at approximately the center of top cup holder 20 which biases the top cup 18 against the bottom cup 16 when the lid is closed. To prevent rotation of top cup 18 during the pill crushing operation, top cup protrusions 18*e* may be aligned and engaged with complementary spaced, respective recesses 20*a* formed about the perimeter of top cup holder 20 (see FIG. 2).

Bottom cup 16 may be removably positioned within complementary shaped bottom cup holder 22. To ensure that bottom cup 16 will rotate together with bottom cup holder 22 during the pill crushing operation, bottom cup protrusions 16*e* may align with and be engaged with complementary spaced respective recesses 22*d* formed about the perimeter of bottom cup holder 22.

Figure 9A:
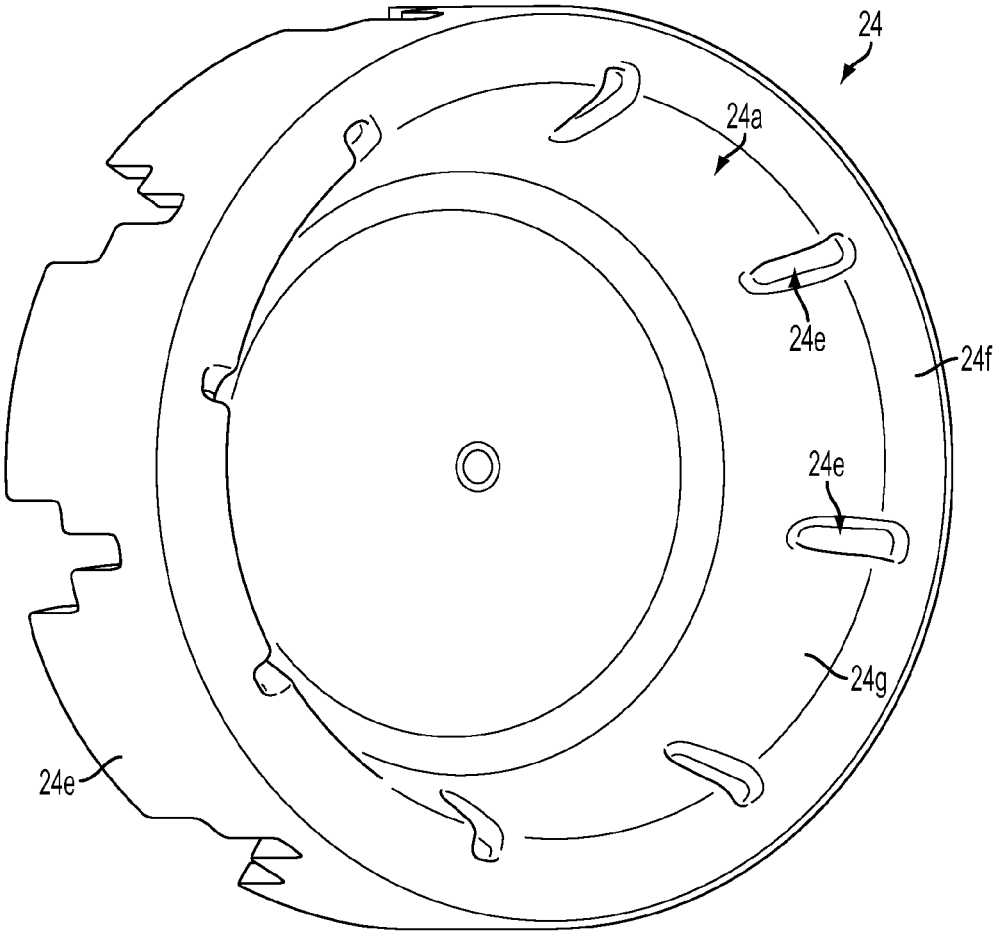
FIGS. 9A and 9B are enlarged, upper and lower end perspective views, respectively, of the rotator base element.

Bottom cup holder 22 (FIGS. 3-5 and 13) includes a bottom wall 22*a*, side wall 22*b* and top perimeter edge 22*c* having a plurality of annularly spaced recesses 22*d* which may align with and engage protrusions 16*e* of bottom cup 16 when placed therein. Bottom cup holder 22 fits within the complementary shaped center recess 24*a* of rotator base element 24 (see also FIGS. 9A and 9B). Rotator base element 24 includes a lower wall segment 24*b* which is radially spaced from a center stem 24*c* having a plurality of annularly spaced vanes 24*d* extending radially outwardly therefrom (see FIG. 9B). Bottom cup holder 22 includes a plurality of annularly spaced rib elements 22*e* which may align with and engage a like plurality of annularly spaced openings 24*e* formed along the lip 24*f* and extending partly down the side wall 24*g* thereof (see FIG. 9A). As such, bottom cup holder 22 is rotationally fixed to rotator base element 24.

Figure 4:
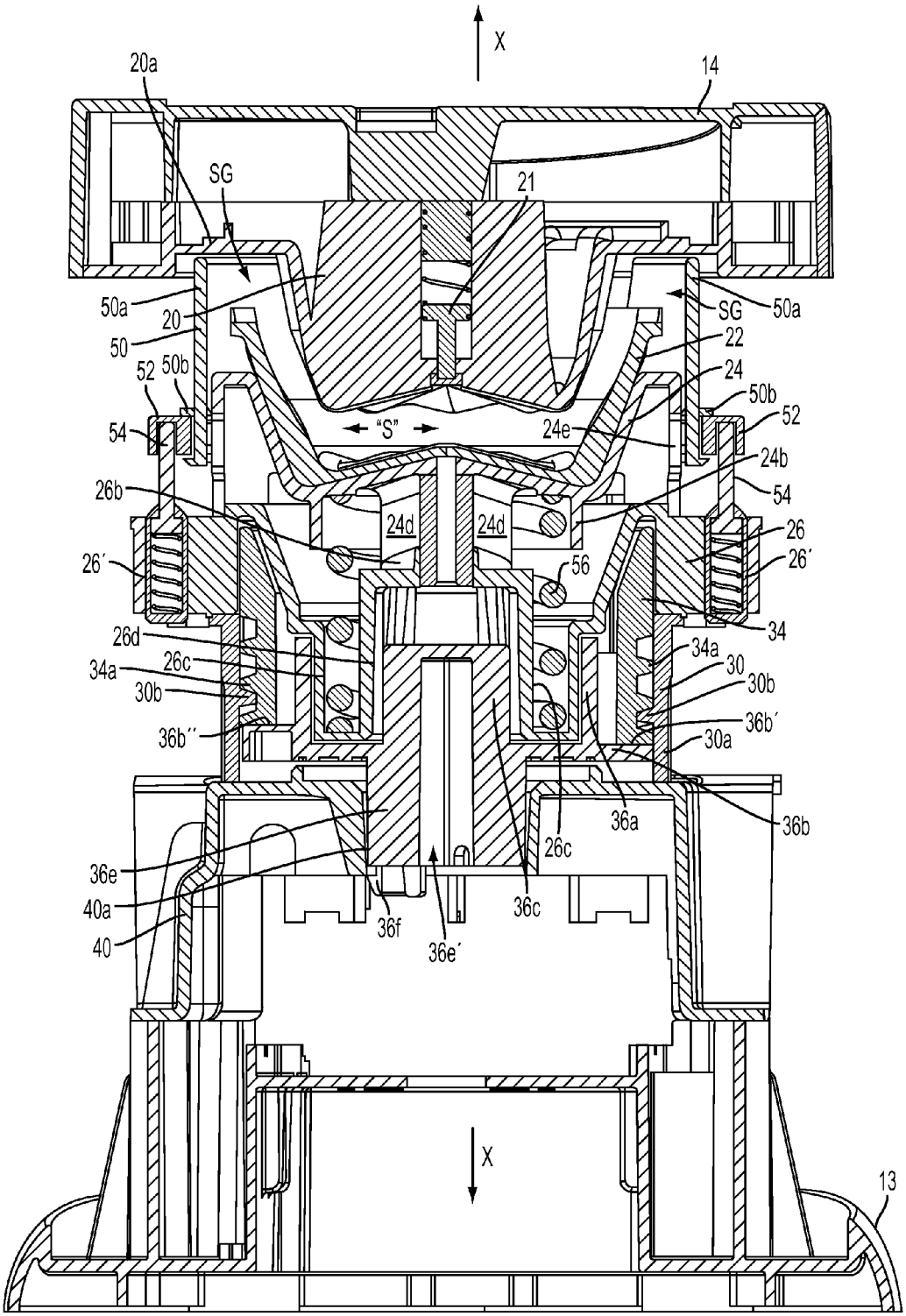
FIG. 4 is a cross-sectional view thereof as taken generally along the line 4-4 of FIG. 3D.
Figure 5:
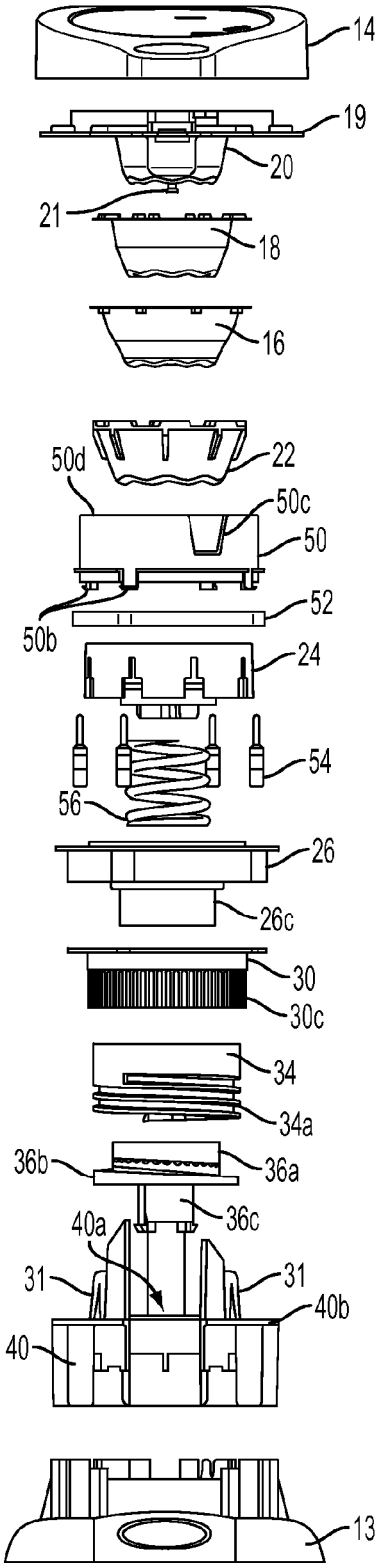
FIG. 5 is an exploded, elevational view thereof.
Figure 6A:
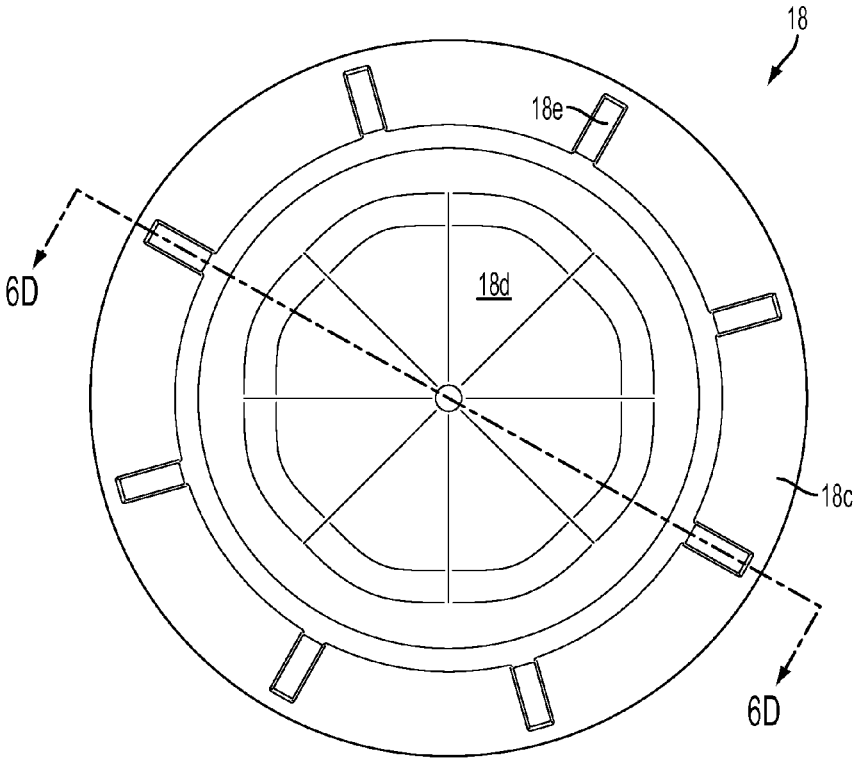
FIGS. 6A-6D are views of the top cup.
Figure 6B:
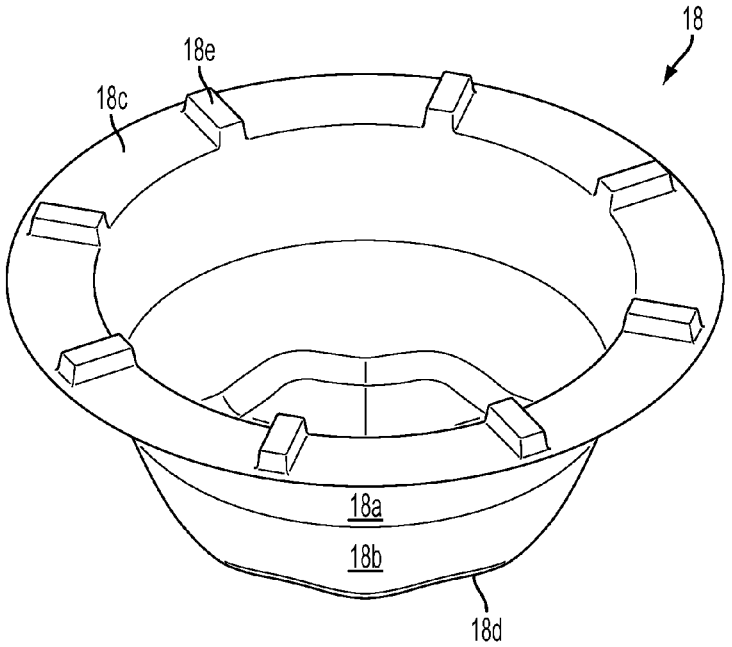
Figure 6C:
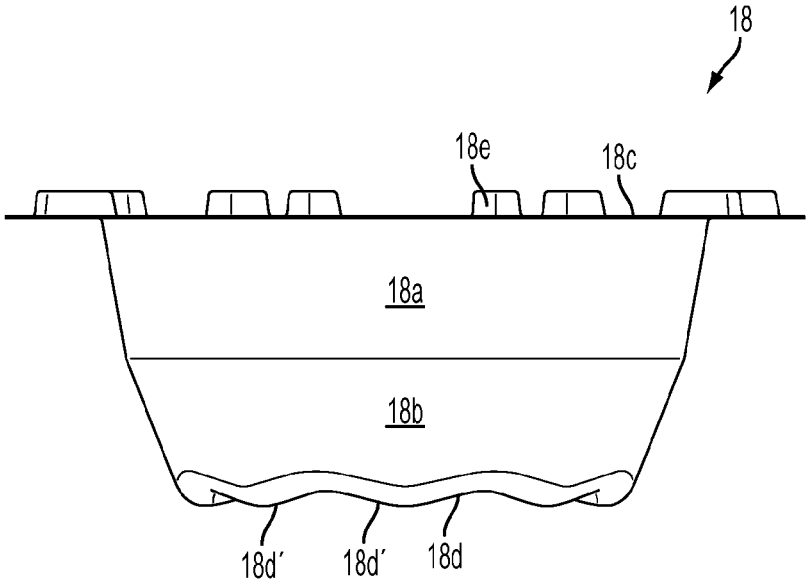
Figure 6D:
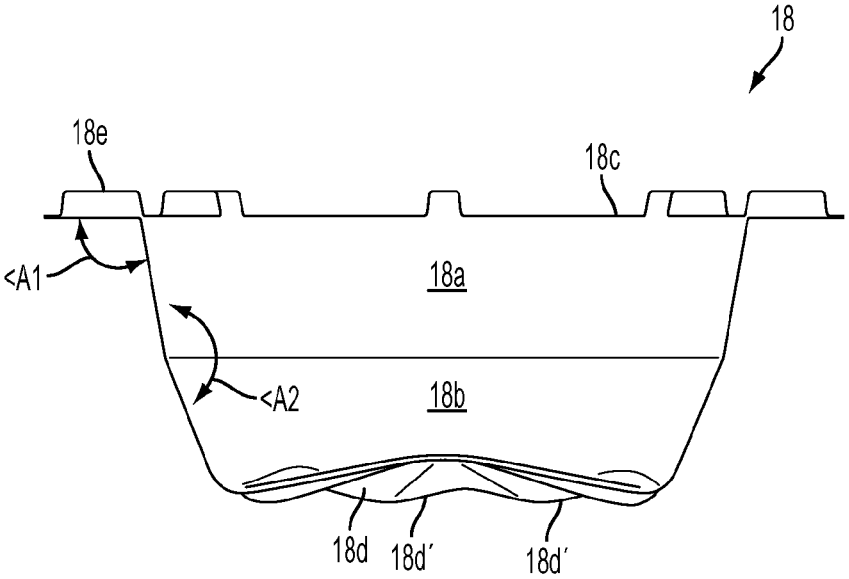
Figure 7A:
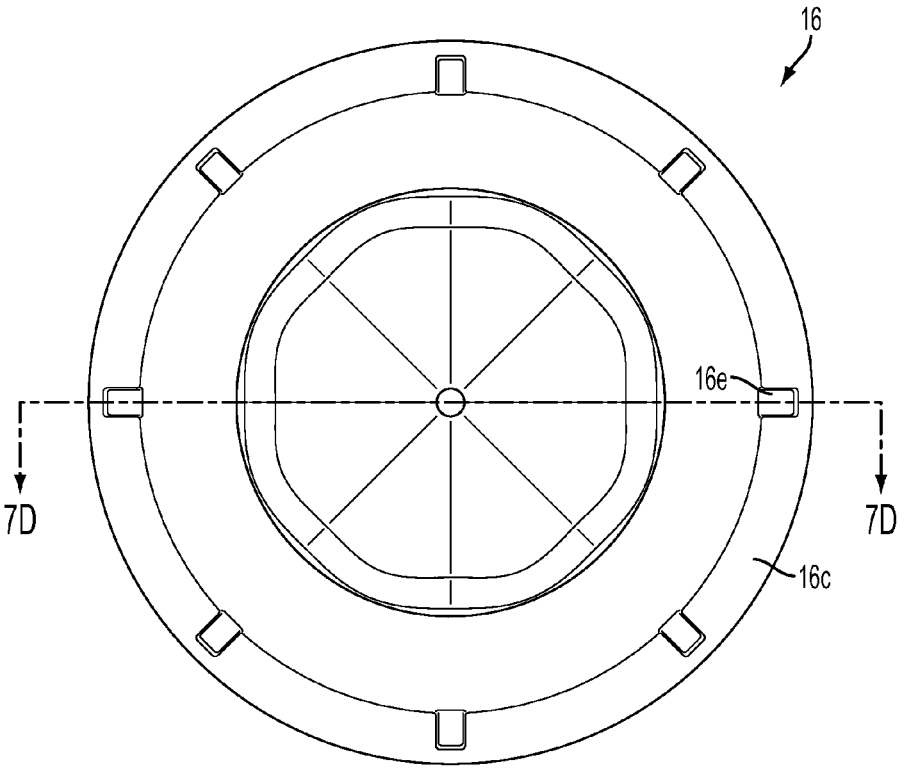
FIGS. 7A-7D are views of the bottom cup.
Figure 7B:
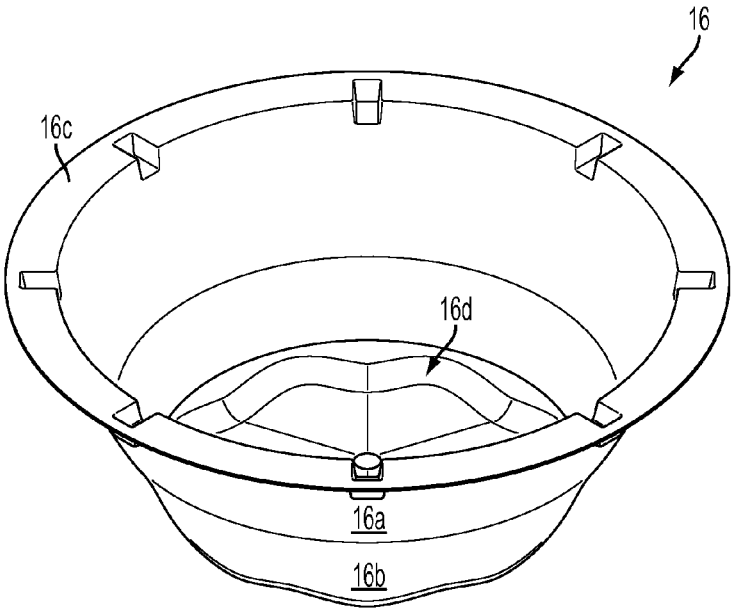
Figure 7C:
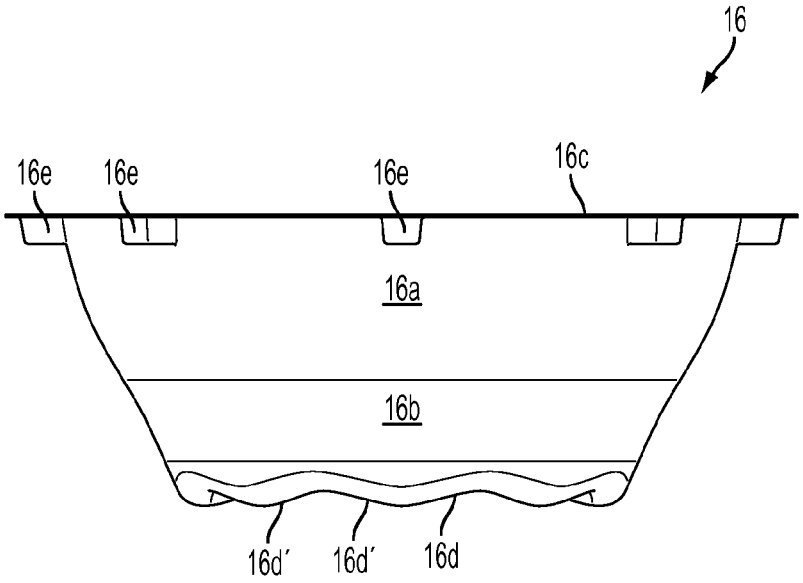
Figure 7D:
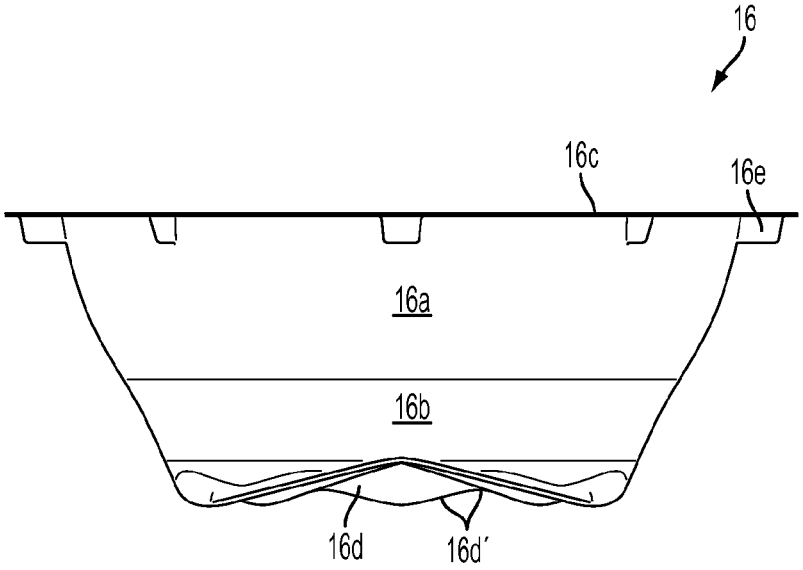
Figure 9B:
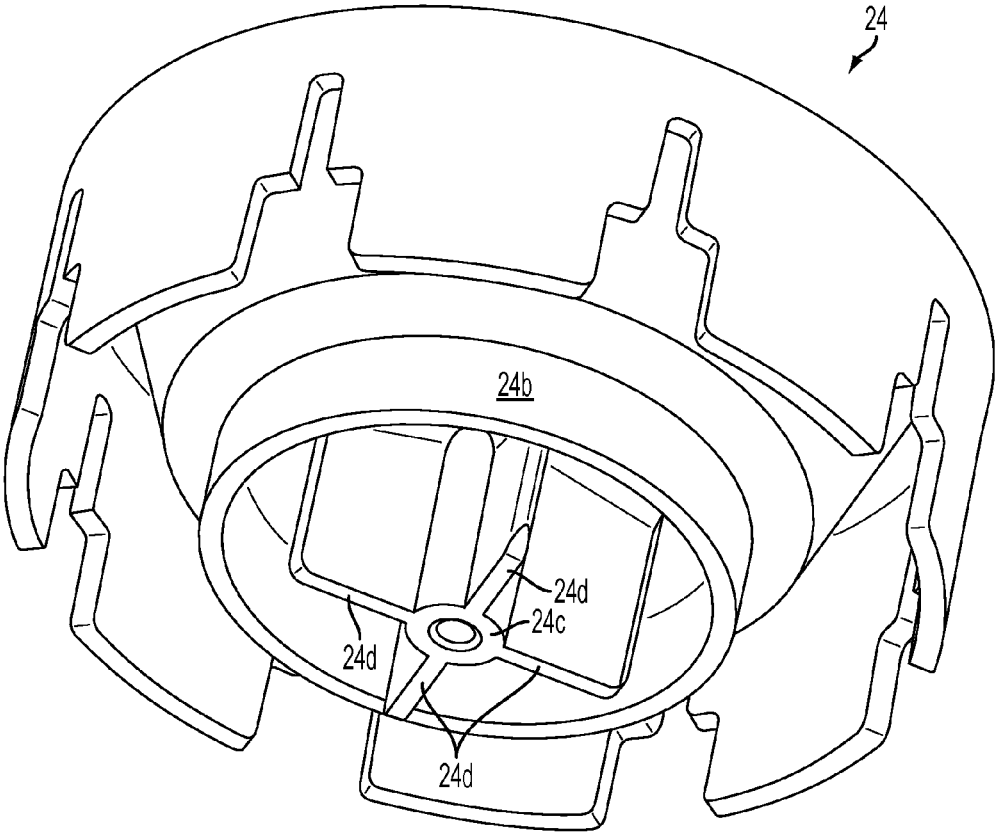
Figure 10A:
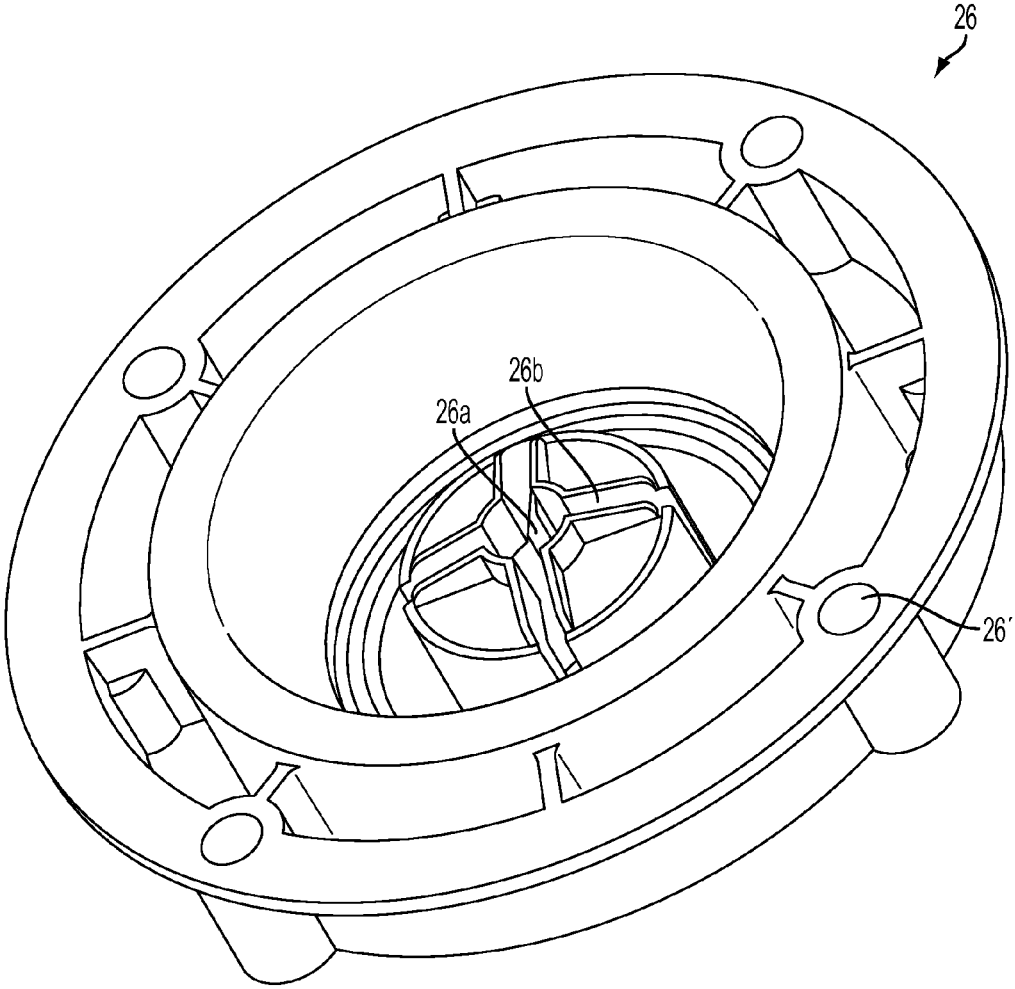
FIGS. 10A and 10B are enlarged, upper and lower end perspective views, respectively, of the second base element.

Rotator base element 24 may be rotationally fixed to a second base element 26 via vanes 24*d* aligning with and fitting within respective walled slots 26*b* which radially extend from center aperture 26*a* (see FIGS. 4, 9B and 10A). Second base element 26 includes a lower annular wall segment 26*c* defining a center bore 26*d* (see FIG. 10B). A third base element 36 (see FIGS. 4, 5 and 12) includes a center stem portion 36*c* which telescopes into center bore 26*d* of second base element 26. As seen best in FIG. 12, third base element 36 further includes a ring element 36*a* which lies concentrically radially outwardly of center stem portion 36*c* which forms an annular channel 36*d* therebetween. With center stem portion 36*c* inserted into center bore 26*d*, annular wall segment 26*c* resides within annular channel 36*d* (see FIG. 4).

Third base element is seen to further include a shoulder portion 36*b* and stem portion 36*e* having a center bore 36*g* into which the output shaft of a drive motor (not shown) positioned there beneath may extend. Shoulder portion 36*b* is further seen to taper in a spiral fashion from a minimum width portion 36*b*' to a maximum width portion 36*b*" which forms a step 36*b*'" for reasons explained below.

Figure 10B:
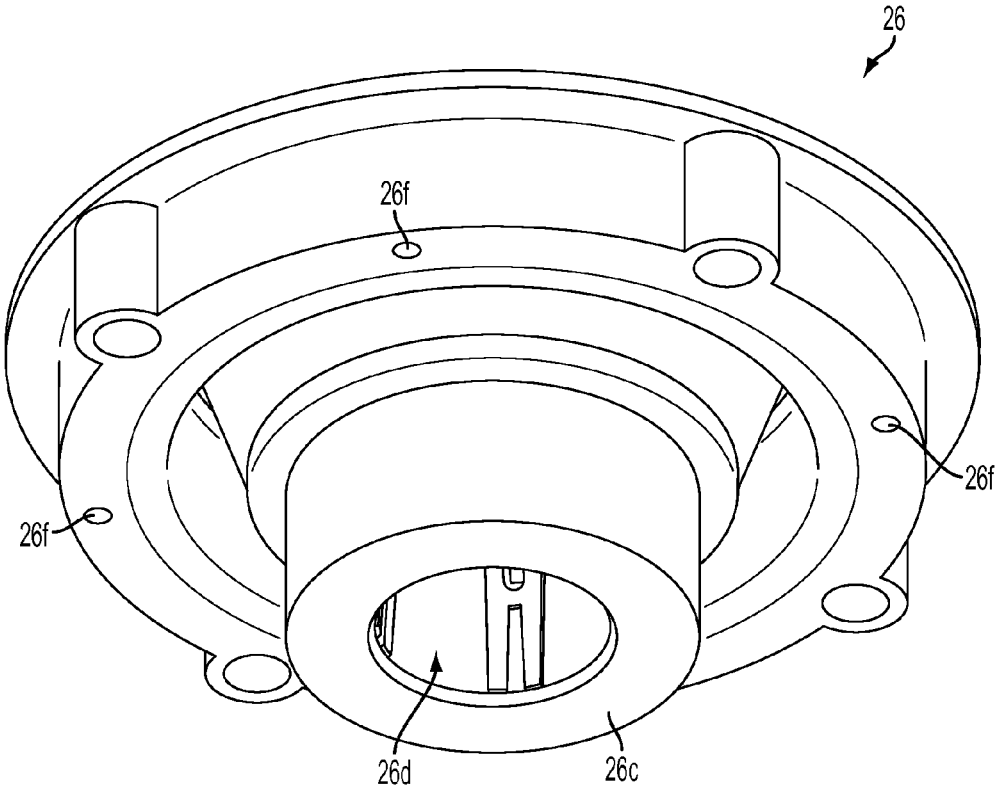
Figure 11:
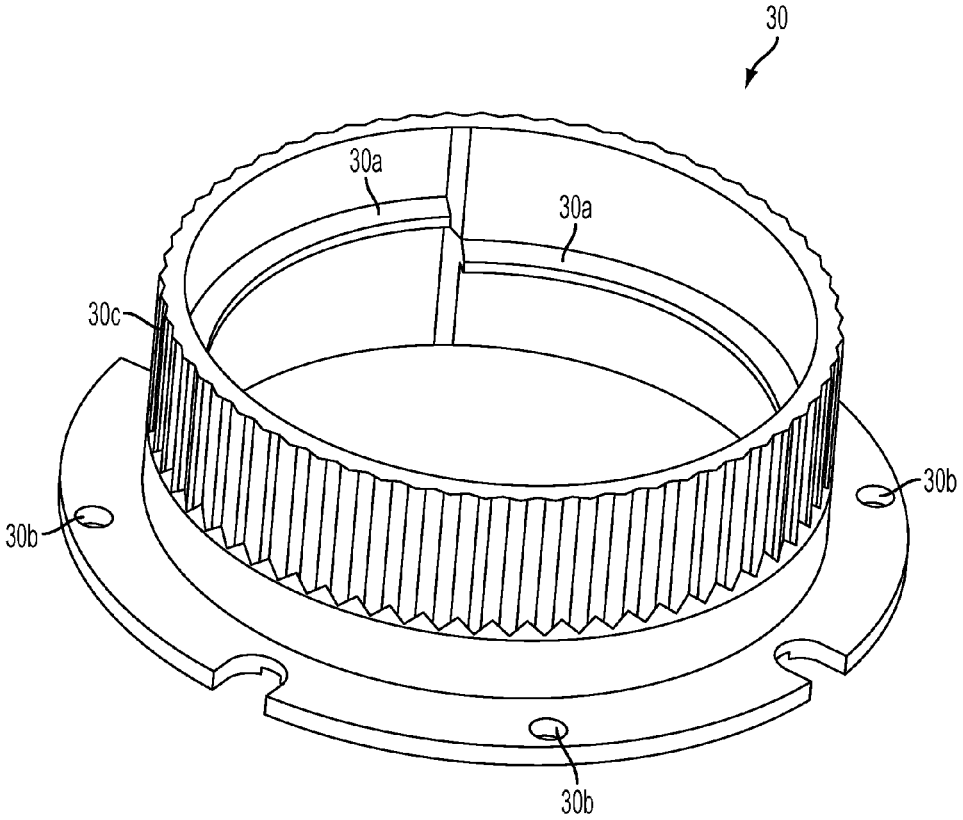
FIG. 11 is a perspective view of the first axial translation element.
Figure 14:
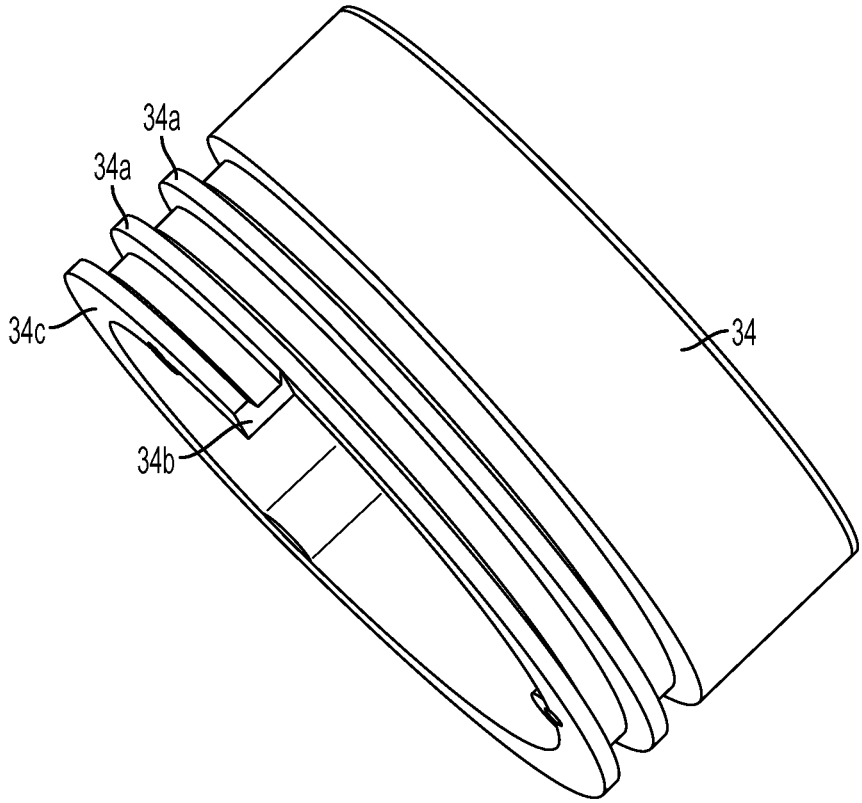
FIG. 14 is a perspective view of the second axial translation element.
Figure 15:
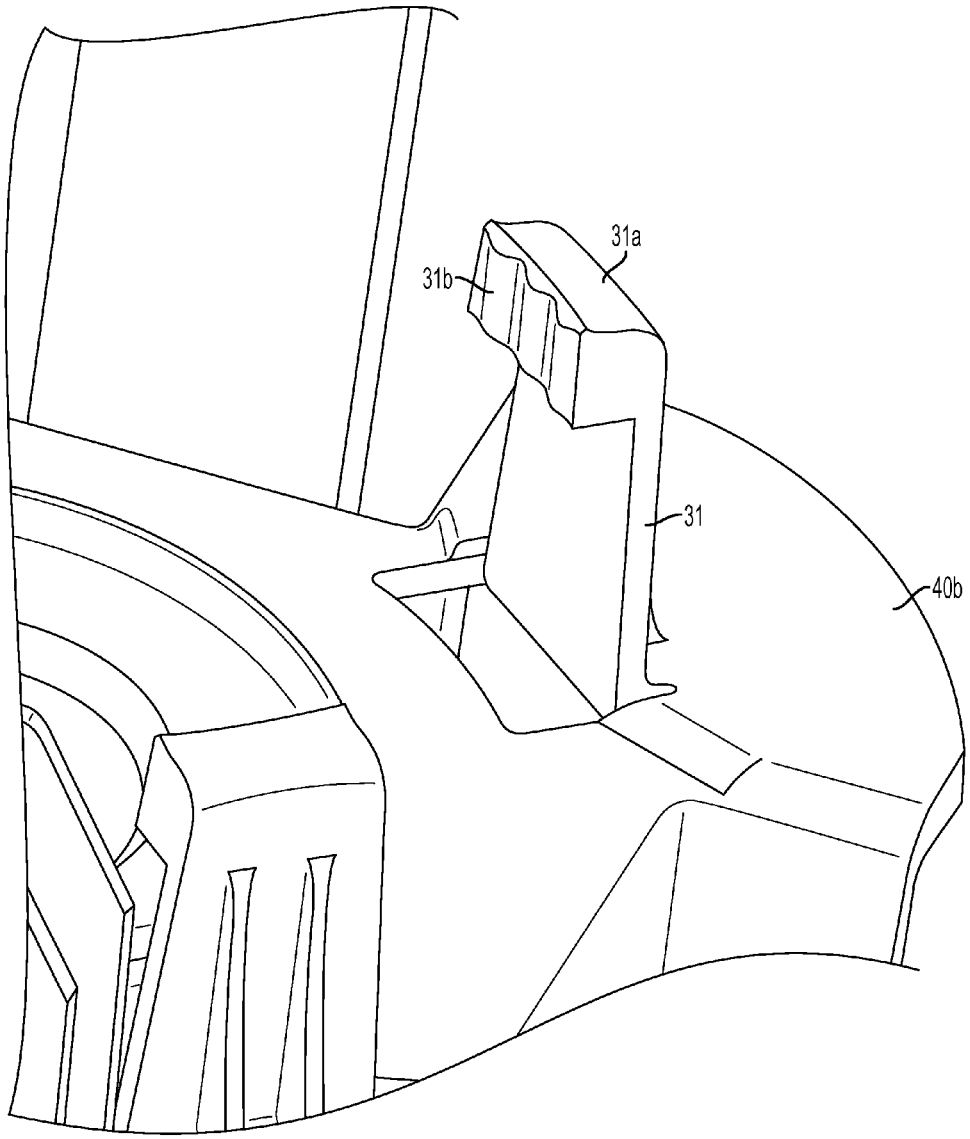
FIG. 15 is an enlarged, fragmented, perspective view of a prong element.

A first axial translation element 30 having internal threads 30*a* and external splined surface 30*c* (see FIGS. 4, 5 and 11) is fixed to second base element 26, e.g., via screws passed through holes 30*b* which align with respective holes 26*f* (see also FIG. 10B). A second axial translation element 34 is provided having threads 34*a* on the outer wall surface thereof and terminating in a ledge portion 34*b* (FIG. 14). The lower surface 34*c* is seated against shoulder portion 36*b* of third base element 36 (FIG. 12) with ledge portion 34*b* abutting step 36*b*'". Second axial translation element 34 resides within first axial translation element 30 with threads 30*a* engaging threads 34*a* (see FIG. 4).

Third base element stem portion 36*e* extends into a center bore 40*a* of a housing mount 40 with stem clips 36*f* (FIG. 12) engaging and fixing third base element 36 to mount 40. Shoulder portion 36*b* is thus seated upon ledge 40*b* of housing mount 40.

A chip guard 50 (FIGS. 4 and 5) is provided which encircles the nesting cups 16, 18 within machine 10. In FIG. 4, cups 16,18 are not shown for the sake of clarity, but would reside in the space "S" between top cup holder 20 and bottom cup holder. The juncture of the cup perimeters wherein gap "G" is formed (FIG. 8) would reside in area indicated by reference arrow SG in FIG. 4. With chip guard wall segment 50*a* located radially outwardly of space SG, any pill fragments "F" which could otherwise escape through this area are physically blocked by the chip guard.

In a preferred embodiment, chip guard 50 has a length extending from top cup holder base wall 20*a* to a position along rotator base element outer side wall 24*e*. A ring element 52 is provided which attaches to chip guard 50 via clips 50*b* integrally formed in the chip guard 50. One or more spring loaded plunger elements 54 connect ring 50 to second base element 26 at holes 26'. As such, spring loaded plunger elements 54 act to bias ring 52 and hence also chip guard 50 toward and against top cup holder base 20*a*. If desired, one or more notches 50*c* may be provided adjacent the top edge 50*d* which provide open access to the nested cups. In an alternate embodiment, plunger elements 54 may be electronically controlled whereby they may be signaled to retract when desired which acts to pull ring 52 and chip guard 50 down (toward housing base 13). The retracted position of chip guard 50 would provide access to the cup sitting in bottom cup holder 22.

In yet another embodiment, chip guard 50 may be fixed to and move together with lid 14 such that when lid 14 is opened, chip guard 50 is lifted away from bottom cup holder 22. Likewise, when lid 14 is closed in preparation for pill crushing operation, guard 50 is lowered into its physical blocking position adjacent gap G.

Figure 12:
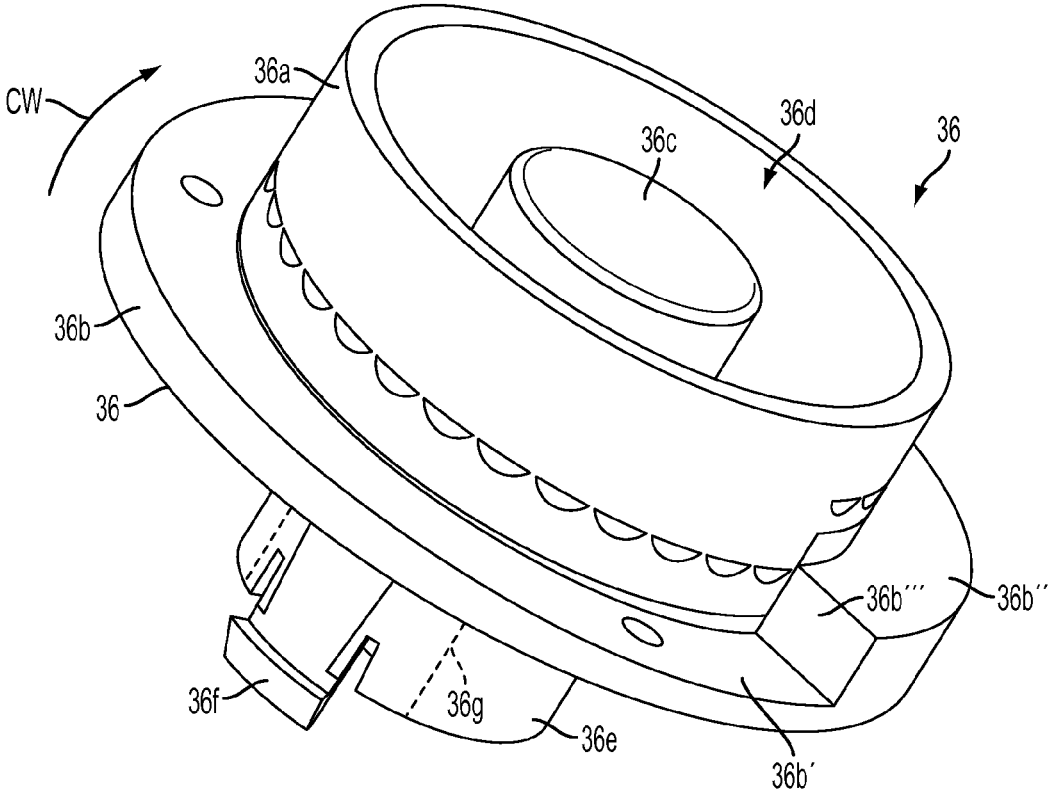
FIG. 12 is a perspective view of the second axial translation element.
Figure 13:
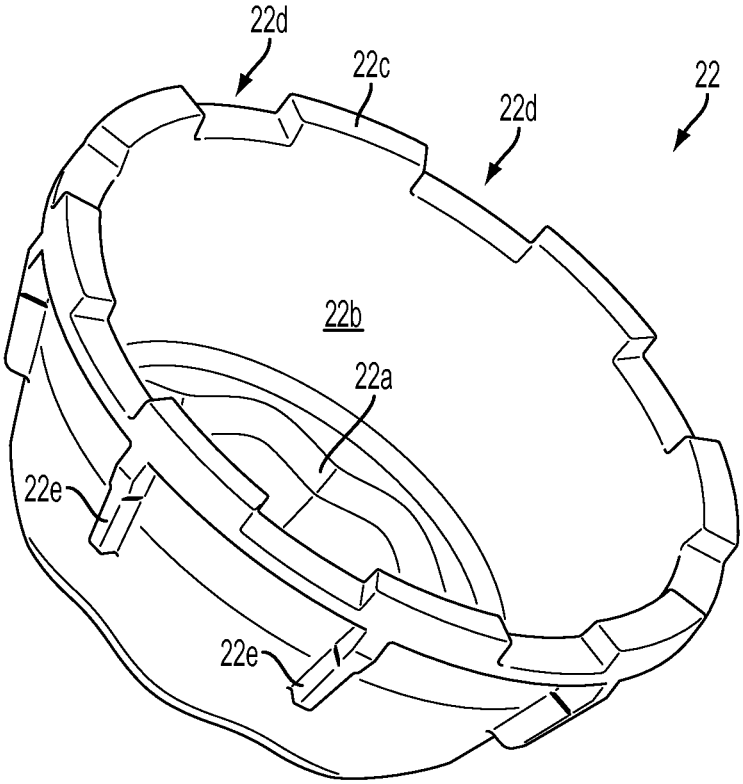
FIG. 13 is a perspective view of the bottom cup holder.

To crush one or more pills, bottom cup 16 is placed in bottom cup holder 22. Pills "P" are placed inside bottom cup 16 and a top cup 18 is placed (nested) inside bottom cup 16 with the pills P located therebetween (FIG. 8). Lid 14 is closed and latched at 15 (FIGS. 3A-3D). The motor (not shown) is activated which rotates third base element 36 as described above. Referring to FIG. 12, rotation of third base element 36 in a clockwise direction "CW" causes step 36*b*" to push against ledge portion 34*b* which causes rotation of second axial translation element 34 in the same direction. First axial translation element 30 is prevented from rotating with second axial translation element 34 due to one or more prongs 31 which extend from ledge 40*b* of housing mount 40.

As seen best in FIG. 14, each prong 31 includes a radially inward extension 31*a* which terminates in a splined face 31*b*. Splined face 31*b* meshes with the splined surface 30*c* of first axial translation element 30 and, since the splines extend in a longitudinal direction (parallel to housing axis X-X), first axial translation element 30 is prevented from rotating while splined face 31*b* is in meshing engagement with splined surface 30*a*. However, since first axial translation element 30 is threadedly engaged to second axial translation element 34 as explained above, first axial translation element 30 will ride along the threads in an upward, axial direction toward lid 14. And since bottom cup holder 22 is rotationally fixed to second base element 26, which in turn is rotationally fixed to rotator base element 24, which in turn is rotationally fixed to bottom cup holder 22, they too will all rotate together with bottom cup holder 22 while translating in the same upward, axial direction. This axial translation presses bottom cup 16 up against top cup 18 (which itself is biased toward bottom cup 16 by spring loaded plunger 21 as described above).

Spring 56 extends between rotator base element 24 and second base element 26 to provide additional biasing force of bottom cup holder 24 in the upward direction toward lid 14. This upward, linear force may act to first crack pills P located between the nesting cups. Once splined surface 30*a* is clear of splined face 31*b*, first axial translation element 30 is free to rotate together with second axial translational element 34. With bottom cup holder interconnected with first axial translation element 30, it too will rotate and cause bottom cup 16 to rotate since they are rotationally fixed together.

Figure 8B:
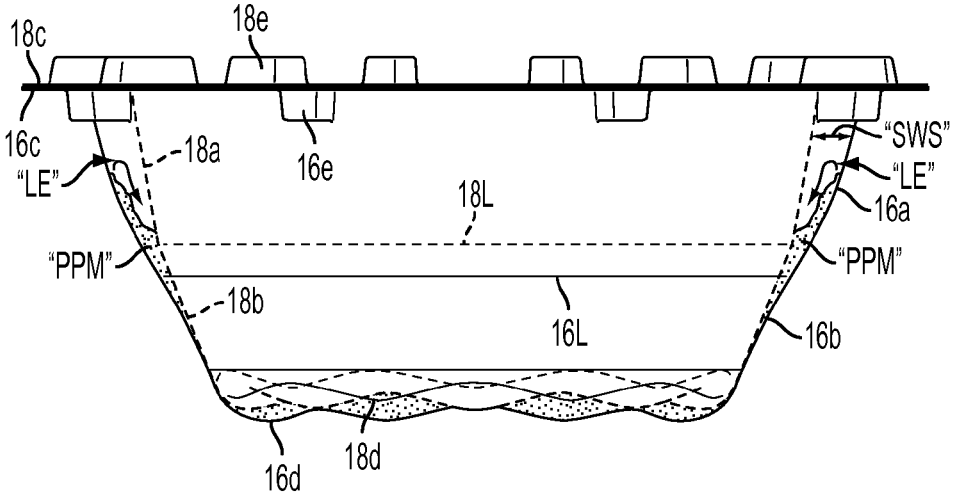

As discussed above, top cup 18 remains rotationally fixed via engagement of protrusions 18*e* with recesses 20*a* in lid 14. As such, bottom cup 16 rotates against and with respect to top cup 18 which provides a crushing and grinding action upon the pills P located therebetween. As seen in FIGS. 8A and 8B, while the crushed pill particles are allowed to migrate in a radially outward direction, and potentially also up between the side walls 16*b*, 18*b* of the top and bottom cups, any pill chip fragments "F" (FIG. 8A) are physically blocked from escaping through gap G by chip guard 50 in the manner explained above. Of course as the pills are being ground into ever smaller particles, the cups begin to move closer together due to the bias forces discussed above. FIG. 8B illustrates the cups very close together at a point near or at the end of the pill crushing operation. The side wall spacing "SWS" between the nesting cups tapers outwardly in a direction toward the cups' top perimeters with the fine pill powder material "PPM" migrating upwardly through this space. The enlarging side wall spacing "SWS" creates enough open area so as to allow the leading edge "LE" of the powdered pill material "PPM" to continuously cascade back down into the cup during the crushing operation such that the powder pill material "PPM" never reaches the cup open top perimeter.

Figure 16:
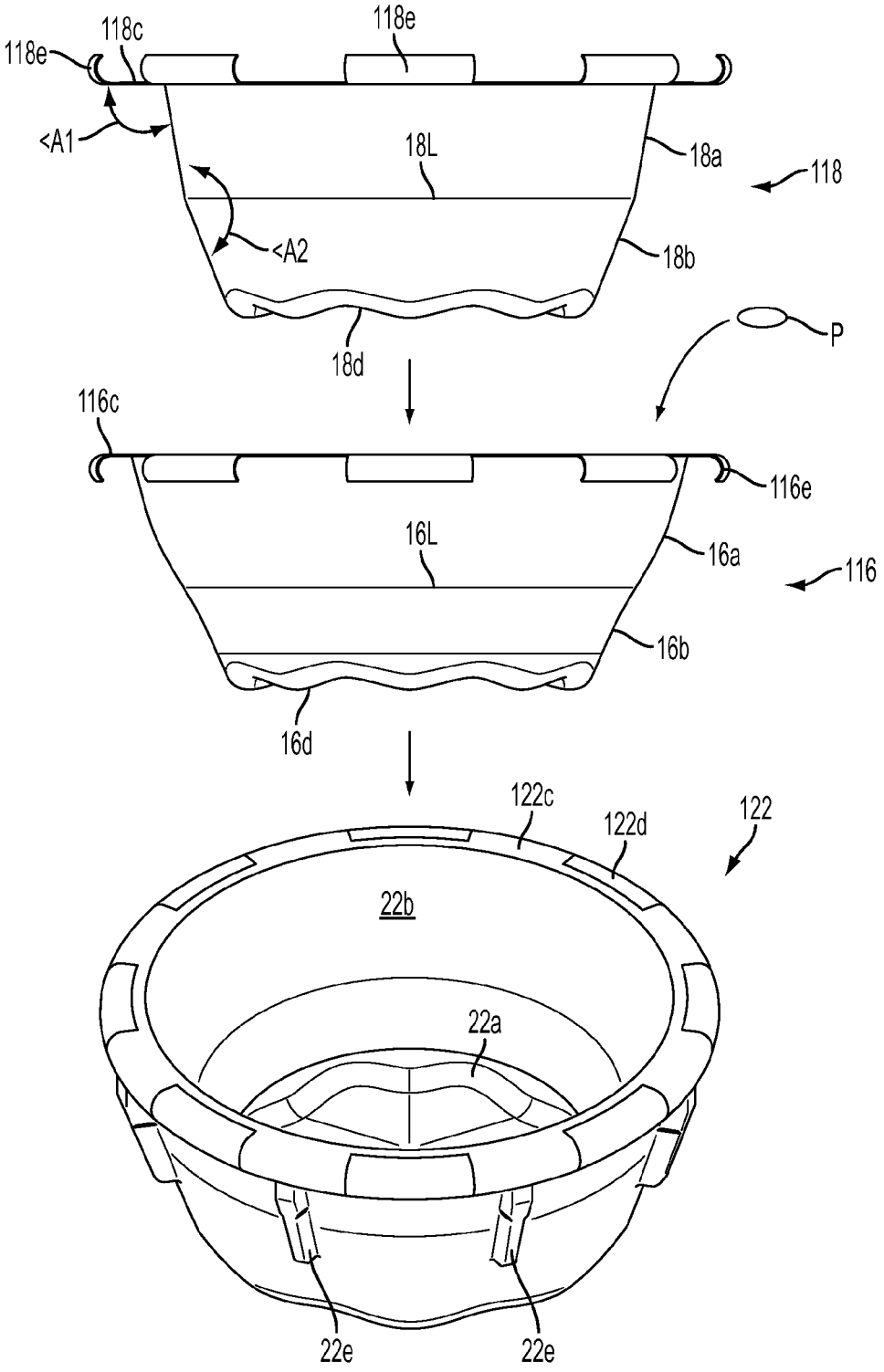
FIG. 16 is a view of an alternative embodiment of nestable bottom and top cups with an associated bottom cup holder.

FIGS. 16-18C show alternative embodiments of bottom and/or top cups suitable for use within pill crushing machine 10 of the present invention. A first alternative embodiment of a top cup 118, bottom cup 116 and bottom cup holder 122 are generally shown in FIGS. 16 and 17A-17B. Similar to top cup 18 and bottom cup 16 described above, nestable cups 116 and 118 are provided for use with machine 10 which are preferably single use and formed of a suitable plastic. Cups 116 and 118 are preferably formed through thermoforming or vacuum forming techniques.

In a preferred embodiment shown, bottom cup 116 and top cup 118 have different dimensions such that top cup 118 nests inside bottom cup 116 with pills "P" to be crushed deposited therebetween. With the exception of perimeter flange 116*c*/118*c* and associated locking lugs 116*e*/118*e*, each cup 116/118 is generally constructed in a similar manner as top cup 18 and bottom cup 16 where top cup 18 is overall generally smaller and has side walls 18*a* and 18*b* (which meet at line 18L) which are straight in the direction from lower wall segment 18*b* to upper perimeter flange 18*c*. Upper wall segment 18*a* extends at an angle A1 of about 100° with respect to perimeter flange 118*c*, and lower wall segment 18*b* extends at an angle A2 of about 170° with respect to upper wall segment 18*a*. Rather than being straight, upper wall segment 16*a* of bottom cup 16 includes having an outwardly curved surface having a radius of about 1.380 mm and a lower wall segment 16*b* (which meets upper wall segment 18*a* at line 18L) having an inwardly curved surface having a radius of about 1.662 mm. The inwardly curved lower wall segment 16*b* interfaces closely with top cup lower segment wall 18*b* to promote fine grinding of the pill particles therebetween while the outwardly curved surface of bottom cup upper wall segment 16*a* interfaces with the sharper angled (i.e., more vertically inclined that the lower wall segment) straight upper wall segment 18*a* of top cup 18 so as to create a large enough space to inhibit pill powder migration. The cup bottom walls 16*d* and 18*d* are of a non-planar configuration and include a radial pattern of fluted sections 16*d*' and 18*d*', respectively. While the sidewalls and bottom walls of the cups are preferably the same as cups 18 and 16, top cup perimeter flange 118*c* of top cup 118 includes a plurality of annularly spaced, upwardly-facing (in a direction away from bottom wall 118*d*) locking lugs 118*e*, and bottom cup perimeter flange 116*c* includes a plurality of annularly spaced, downwardly-facing (in a direction toward bottom wall 116*d*) locking lugs 116*e*.

As shown in FIG. 16, bottom cup holder 122 includes a bottom wall 22*a*, side wall 22*b* and top perimeter edge 122*c* having a plurality of annularly spaced recesses 122*d* which may align with and engage locking lugs 116*e* of bottom cup 116 when placed therein. Bottom cup holder 122 is configured to fit within the complementary shaped center recess 24*a* of rotator base element 24 as described above with regard to bottom cup holder 22. Bottom cup holder 122 includes a plurality of annularly spaced rib elements 22*e* which may align with and engage a like plurality of annularly spaced openings 24*e* formed along the lip 24*f* and extending partly down the side wall 24*g* thereof of rotator base element 24 (see FIG. 9A). As such, bottom cup holder 122 is rotationally fixed to rotator base element 24.

Figure 17A:
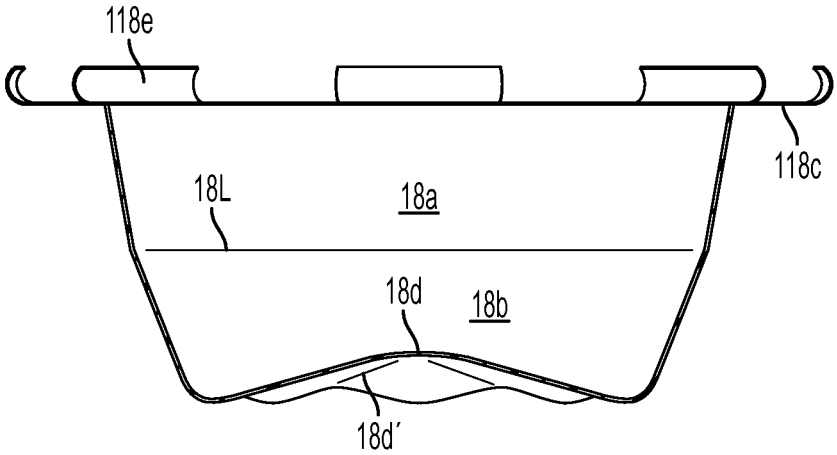
FIGS. 17A and 17B are cross-sectional views of the nestable bottom and top cups shown in FIG. 16.
Figure 17B:
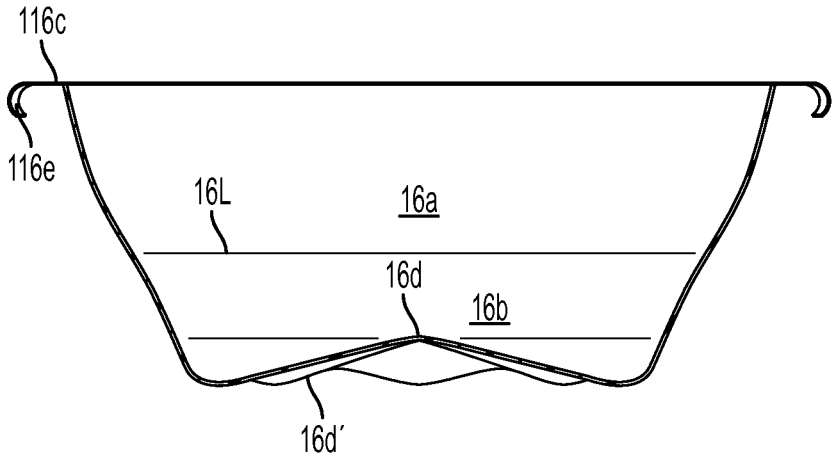

Bottom cup 116 may be removably positioned within complementary shaped bottom cup holder 122. To ensure that bottom cup 116 will rotate together with bottom cup holder 122 during the pill crushing operation, bottom cup locking lugs 116*e* may align with and be engaged with complementary spaced respective recesses 122*d* formed about the perimeter of bottom cup holder 122. In a preferred embodiment, each locking lug 116*e* is proportioned so as to seat the entire length of the locking lug within its respective recess 122*d* such that substantially all of the recess is occupied by the lug. As used herein, "substantially all" shall mean all of the recess is to be occupied except for that minimal amount of space required for sufficient positioning of the lug within the recess. In a preferred embodiment, each lug is proportioned to fit snuggly within its respective recess. In this manner, locking lugs 116*e* are virtually instantly engaged by the sidewalls of recesses 122*d* upon rotational activation of the crushing mechanism. This minimizes, and preferably eliminates, any lateral force applied to the locking lugs upon initiation of rotation. Furthermore, as shown in FIGS. 16 and 17A-17B, locking lugs 116*e* are preferably formed to include a curved profile (such as when viewed in transverse cross-section as taken along section line A-A in FIG. 18A). This curved profile serves to strengthen the structural integrity of the locking lug thereby further resisting locking lug distortion, flexion or other deformation when rotationally engaged by bottom cup holder 122. Although not shown, a top cup holder, similar to top cup holder 20 described above, is provided which would include complementary spaced recesses configured to align with and engage top cup locking lugs 118*e* to ensure that top cup 118 remains stationary upon rotational actuation of bottom cup holder 122/bottom cup 116.

Figure 18A:
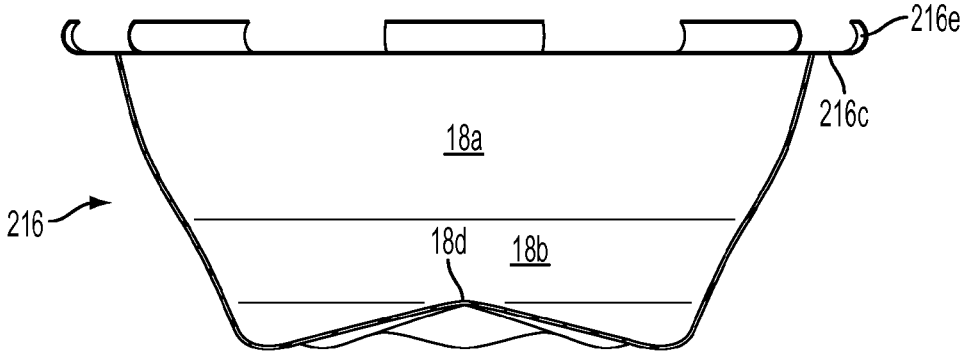
FIGS. 18A, 18B and 18C are cross-sectional views of further alternative embodiments of a bottom cup suitable for use within a pill crushing machine of the present invention.
Figure 18B:
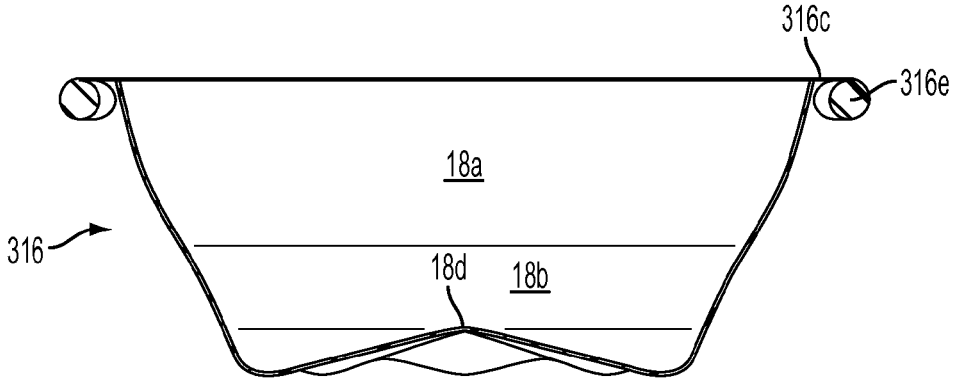
Figure 18C:
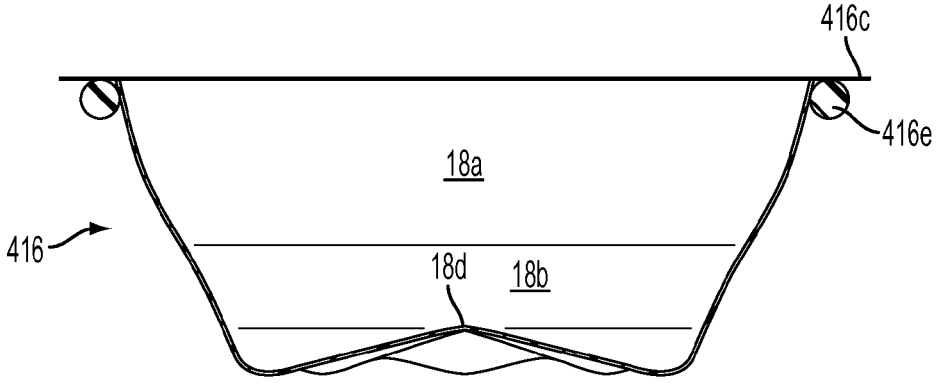

FIGS. 18A-18C show additional alternative embodiments of a bottom cup amenable for use within a pill crushing machine. It should be noted that, although shown and described as alternative embodiments of bottom cups, it is envisioned that the drawings and descriptions may also be equally suitably directed to alternative embodiments of a top cup. It should further be noted that for each of the various alternative embodiments, a corresponding complementary cup holder (top and/or bottom) will be provided so as to align with and engage each embodiment's distinctive locking lug to ensure proper rotational grinding of a pill within the pill crushing machine. Similar to bottom cup 116, bottom cup 216 (FIG. 18A), bottom cup 316 (FIG. 18B) and bottom cup 416 (FIG. 18C) each generally comprise a cup structure consisting of sidewalls 18*a*/18*b* along with a bottom wall 18*d*. However, each bottom cup includes a unique flange/locking lug profile.

As can been seen in FIG. 18A, bottom cup 216 has a perimeter flange 216*c* carrying a plurality of spaced, upwardly extending locking lugs 216*e*. Locking lugs 216*e* are similar in cross section to lugs 116*e* shown in FIGS. 16 and 17B, but project upwardly away from the bottom cup bottom wall 18*d*. Thus, when seated within a complementary bottom cup holder, the upwardly projecting locking lugs provide a convenient lift surface such that an operator may quickly and easily extract the bottom cup (with powdered pill material contained therein) from the bottom cup holder. In a further embodiment of bottom cup 216, one or more locking lugs 216*e* may include preformed perforations at the union of the locking lug and the flange. In this manner, one or more of the locking lugs 216*e* may be removed from the bottom cup after pulverizing the pill (and optional mixing with a suitable swallowing aid) so as to enable more convenient administration of the powered pill to the patient.

Turning now to FIGS. 18B and 18C, alternative bottom cups 316 and 416, respectively, may be manufactured so as to include a closed curve locking lug 316*e*/416*e*, respectively. It is envisioned that locking lug 316*e* and/or 416*e* may be either an open profile closed curve (i.e. a ring) or a closed profile closed curve (i.e. a rod). Further, the location of the locking lug on the surface of the perimeter flange may be customized. At one extreme, as shown in FIG. 18B, locking lug 316*e* may be located at the distal end of perimeter flange 316*c*. Alternatively, at the other extreme, locking lug 416*e* may be located on perimeter flange 416*c* immediately adjacent upper sidewall 18*a*.

As discussed above, each of bottom cups 116, 216, 316 and 416, and/or top cup 118 is preferably fabricated through thermoforming or vacuum forming techniques. In a first step of a method to thermoform or vacuum form the top and/or bottom cups, a thin sheet of thermoformable plastic is heated within an oven until pliable. The heated plastic sheet is then removed from the oven and introduced to a mold. The mold can be a positive and/or negative mold wherein the plastic sheet is stretched to form the shape of the finished cup. In vacuum forming, a vacuum may be applied to the mold to draw the plastic into or around the mold features. The thermoformed plastic sheet is then cooled and ejected from the mold. In a preferred embodiment, the upper perimeter flanges 116*c*/216*c*/316*c*/416*c* of each cup are sufficiently flexible such that each respective locking lug 116*e*/216*e*/316*e*/416*e* freely disassociates from the mold. Alternatively, a stripper may physically separate the thermoformed sheet with the finished cups from the underlying mold. The ejected sheet with formed cups is then directed to a trim station when the cups are excised from the sheet. The unformed portion of the sheet is then recycled for further use while the finished cups are stacked and packaged.

While this method and apparatus has been shown and described with reference to certain preferred embodiments thereof, it will be understood by those skilled in the art that various changes in form and details may be made therein without departing from the spirit and scope of the invention as described.

What is claimed is:

1. A pill cup adapted for use with a pill crushing apparatus, the pill crushing apparatus including a cup holder configured to removably hold the pill cup and a cup mating surface axially aligned and insertable within the pill cup such that a rotational interaction between the pill cup and the cup mating surface imparts a grinding force against one or more pills held between the pill cup and the cup mating surface, the pill cup comprising:

a) a bottom wall;

b) an integral upwardly extending sidewall; and c) an upper perimeter flange wherein said upper perimeter flange includes a plurality of annularly spaced locking lugs configured to align with and engage a plurality of complementary spaced recesses on the cup holder such that each respective locking lug engages substantially all of its respective recess.

2. The pill cup of claim 1 wherein said bottom wall includes a radial pattern of fluted sections.

3. The pill cup of claim 1 wherein said upwardly extending sidewall has an inner wall surface having a vertical cross section different than a vertical cross section of an external surface of said cup mating surface.

4. The pill cup of claim 3 wherein said upwardly extending sidewall includes an upper wall segment having an outwardly curved surface and a lower wall segment having an inwardly curved surface.

5. The pill cup of claim 4 wherein said outwardly curved surface has a radius of about 1.380 mm (0.054 inches) and said inwardly curved surface has a radius of about 1.662 mm (0.065 inches).

6. The pill cup of claim 1 wherein each of said locking lugs has a curved transverse cross section.

7. The pill cup of claim 6 wherein each of said curved transverse cross section forms an open completed circle.

8. The pill cup of claim 7 wherein said curved transverse cross section forms a solid completed circle.

9. A pill cup assembly having nestable first and second cups adapted for use with a pill crushing apparatus, the pill crushing apparatus including a cup holder configured to removably hold the first cup and a cup mounting surface configured to axially align and releasably engage the second cup with the first cup such that rotation of one cup relative to the other cup imparts a grinding force against one or more pills held between the first and second cups, the pill cup assembly comprising:

a first cup and a second cup, wherein each of said first and second cups comprises:

a) a bottom wall;

b) an integral upwardly extending sidewall; and c) an upper perimeter flange wherein said upper perimeter flange includes a plurality of annularly spaced locking lugs configured to align with and engage a plurality of complementary spaced recesses on a respective cup holder or a respective cup mounting surface such that each respective locking lug engages substantially all of its respective recess.

10. The pill cup assembly of claim 9 wherein each of said bottom walls includes a complementary radial pattern of fluted sections.

11. The pill cup of claim 9 wherein said upwardly extending sidewall of said first cup has an inner wall surface having a vertical cross section different than a vertical cross section of an outer wall surface of said upwardly extending sidewall of said second cup.

12. The pill cup assembly of claim 11 wherein said upwardly extending sidewall of said first cup includes an upper wall segment having an outwardly curved surface and a lower wall segment having an inwardly curved surface and wherein upwardly extending sidewall of said second cup includes an upper wall segment and a lower wall segment with the lower wall segment of the second cup adapted to interface closely with said lower wall segment of said first cup so as to promote said grinding force and wherein said upper wall segment of said first cup and the upper wall segment of the second cup create a gap which tapers outwardly in a direction toward said upper perimeter flange of said first cup.

13. The pill cup assembly of claim 12 wherein said outwardly curved surface has a radius of about 1.380 mm (0.054 inches), said inwardly curved surface has a radius of about 1.662 mm (0.065 inches), said upper wall segment of said second cup extending at an angle of about 100° with respect to said upper perimeter flange of said second cup, and wherein said lower wall segment of said second cup extends at an angle of about 170° with respect to said upper wall segment of said second cup.

14. The pill cup assembly of claim 9 wherein each of said locking lugs has a curved transverse cross section.

15. The pill cup assembly of claim 14 wherein said curved transverse cross section forms an open completed circle.

16. The pill cup assembly of claim 15 wherein said curved transverse cross section forms a closed completed circle.

* * * * *